US010590360B2

(12) United States Patent
Yeh et al.

(10) Patent No.: US 10,590,360 B2
(45) Date of Patent: Mar. 17, 2020

(54) BRIGHT STOCK PRODUCTION FROM DEASPHALTED OIL

(71) Applicant: ExxonMobil Research and Engineering Company, Annandale, NJ (US)

(72) Inventors: Lisa I-Ching Yeh, Marlton, NJ (US); Rugved P. Pathare, Sarnia (CA); Eric B. Senzer, Margate, FL (US); Camden N. Henderson, Mullica Hill, NJ (US); Tracie L. Owens, Houston, TX (US); Kendall S. Fruchey, Easton, PA (US); Timothy L. Hilbert, Middleburg, VA (US); Michael B. Carroll, Center Valley, PA (US); Debra A. Sysyn, Monroe, NJ (US); Kathleen E. Edwards, Freehold, NJ (US); Bryan E. Hagee, Hamilton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 195 days.

(21) Appl. No.: 15/390,943

(22) Filed: Dec. 27, 2016

(65) Prior Publication Data

US 2017/0211005 A1 Jul. 27, 2017

Related U.S. Application Data

(60) Provisional application No. 62/271,543, filed on Dec. 28, 2015.

(51) Int. Cl.
*C10M 101/02* (2006.01)
*C10G 67/04* (2006.01)

(52) U.S. Cl.
CPC ..... *C10M 101/02* (2013.01); *C10G 67/0454* (2013.01); *C10G 67/0463* (2013.01); *C10G 2300/1077* (2013.01); *C10G 2400/10* (2013.01); *C10M 2203/1006* (2013.01); *C10N 2220/022* (2013.01); *C10N 2220/023* (2013.01); *C10N 2220/025* (2013.01); *C10N 2220/031* (2013.01); *C10N 2230/43* (2013.01)

(58) Field of Classification Search
CPC ..... C10M 101/02; C10M 2203/1006; C10N 2220/022; C10N 2220/023; C10N 2220/025; C10N 2220/031; C10G 67/0454; C10G 67/0463; C10G 240/10
See application file for complete search history.

(56) References Cited

U.S. PATENT DOCUMENTS

| | | | |
|---|---|---|---|
| 1,815,022 | A | 7/1931 | Davis |
| 1,948,296 | A | 2/1934 | Haylett |
| 2,015,748 | A | 10/1935 | Frolich |
| 2,081,473 | A | 5/1937 | Bray et al. |
| 2,100,993 | A | 11/1937 | Bruson |
| 2,191,498 | A | 2/1940 | Reiff |
| 2,213,798 | A | 9/1940 | Anne |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,940,920 | A | 6/1960 | Leo |
| 3,036,003 | A | 5/1962 | Verdol |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer et al. |
| 3,275,554 | A | 9/1966 | Wagenaar |
| 3,287,254 | A | 11/1966 | Paterson |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | LeSuer et al. |
| 3,413,347 | A | 11/1968 | Worrel |
| 3,414,506 | A | 12/1968 | Van Lookeren Campagne |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer et al. |

(Continued)

FOREIGN PATENT DOCUMENTS

| | | | |
|---|---|---|---|
| CA | 1094044 | A | 1/1981 |
| EP | 0099141 | A | 1/1984 |

(Continued)

OTHER PUBLICATIONS

The International Search Report and Written Opinion of PCT/US2016/068784 dated Jun. 6, 2017.
The International Search Report and Written Opinion of PCT/US2016/068778 dated Jun. 12, 2017.
The International Search Report and Written Opinion of PCT/US2016/068781 dated Jun. 14, 2017.
The International Search Report and Written Opinion of PCT/US2016/068796 dated May 29, 2017.
The International Search Report and Written Opinion of PCT/US2016/068801 dated Apr. 21, 2017.
The International Search Report and Written Opinion of PCT/US2016/068803 dated Jun. 9, 2017.

(Continued)

*Primary Examiner* — James C Goloboy
(74) *Attorney, Agent, or Firm* — Robert A. Migliorini; Scott F. Yarnell

(57) ABSTRACT

Compositions are provided for lubricant base stocks produced from feeds such as vacuum resid or other 510° C.+ feeds. A feed can be deasphalted and then catalytically and/or solvent processed to form lubricant base stocks, including bright stocks that are resistant to haze formation.

31 Claims, 13 Drawing Sheets

(56) References Cited

U.S. PATENT DOCUMENTS 3,519,565 A 7/1970 Coleman
3,541,012 A 11/1970 Stuebe
3,565,804 A 2/1971 Honnen et al.
3,595,791 A 7/1971 Cohen
3,627,675 A 12/1971 Ditman et al.
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,751,365 A 8/1973 Piasek et al.
3,755,433 A 8/1973 Miller et al.
3,756,953 A 9/1973 Piasek et al.
3,765,911 A 10/1973 Knowles et al.
3,787,374 A 1/1974 Adams
3,798,165 A 3/1974 Piasek et al.
3,803,039 A 4/1974 Piasek et al.
3,822,209 A 7/1974 Knapp et al.
3,830,723 A 8/1974 Ladeur et al.
3,948,800 A 4/1976 Meinhardt
4,100,082 A 7/1978 Clason et al.
4,125,459 A 11/1978 Garwin
4,234,435 A 11/1980 Meinhardt et al.
4,426,305 A 1/1984 Malec
4,454,059 A 6/1984 Pindar et al.
4,686,028 A 8/1987 Van Driesen et al.
4,715,946 A 12/1987 Le Page et al.
4,767,551 A 8/1988 Hunt et al.
4,798,684 A 1/1989 Salomon
4,810,367 A 3/1989 Chombart et al.
4,982,051 A 1/1991 Pasternak et al.
5,084,197 A 1/1992 Galic et al.
5,124,025 A 6/1992 Kolstad et al.
5,302,279 A 4/1994 Degnan et al.
5,358,627 A 10/1994 Mears et al.
5,705,458 A 1/1998 Roby et al.
5,871,634 A 2/1999 Wiehe et al.
5,976,353 A 11/1999 Cody et al.
6,034,039 A 3/2000 Gomes et al.
6,191,078 B1 * 2/2001 Shlomo ..... C10M 133/56 508/273
6,241,874 B1 6/2001 Wallace et al.
6,323,164 B1 11/2001 Liesen et al.
6,409,912 B1 6/2002 Wallace et al.
6,461,497 B1 10/2002 Pedersen
6,533,925 B1 3/2003 Wallace et al.
6,814,856 B1 11/2004 Aussillous et al.
7,029,571 B1 4/2006 Bharracharyya et al.
7,261,805 B2 8/2007 Grove et al.
7,279,090 B2 10/2007 Colyar et al.
7,381,321 B2 6/2008 Benazzi et al.
7,513,989 B1 4/2009 Soled et al.
7,598,426 B2 10/2009 Fang et al.
7,704,930 B2 4/2010 Deckman et al.
7,776,206 B2 8/2010 Miller et al.
8,048,833 B2 11/2011 Habeeb et al.
8,361,309 B2 1/2013 Lopez et al.
8,366,908 B2 2/2013 Prentice et al.
8,394,255 B2 3/2013 McCarthy et al.
8,492,321 B2 7/2013 Goujon et al.
8,513,150 B2 8/2013 Wu
8,541,635 B2 9/2013 Landschof
8,557,106 B2 10/2013 Novak et al.
8,617,383 B2 12/2013 Prentice et al.
8,658,030 B2 2/2014 Osaheni et al.
8,778,171 B2 7/2014 Oliveri et al.
8,785,354 B2 7/2014 Westelynck et al.
8,932,454 B2 1/2015 Wu et al.
8,992,764 B2 3/2015 Prentice et al.
9,005,380 B2 4/2015 Mathur
9,035,113 B2 5/2015 Lopez et al.
9,200,218 B2 12/2015 Dougherty et al.
9,418,828 B2 8/2016 Mennito et al.
2002/0005374 A1 1/2002 Roby, Jr. et al.
2004/0094453 A1 5/2004 Lok et al.
2004/0178118 A1 9/2004 Rosenbaum et al.
2004/0250466 A1 12/2004 Fang et al.
2005/0051463 A1 * 3/2005 Miller ..... C10G 65/12 208/58
2005/0098476 A1 5/2005 Miller
2006/0101712 A1 5/2006 Burnett et al.
2006/0111599 A1 5/2006 Lamprecht et al.
2006/0118463 A1 6/2006 Colyar et al.
2006/0163115 A1 7/2006 Montanari et al.
2007/0181461 A1 8/2007 Adams et al.
2008/0149534 A1 6/2008 Gauthier et al.
2008/0308459 A1 12/2008 Iki et al.
2009/0294328 A1 12/2009 Iqbal
2009/0313890 A1 12/2009 Lopez et al.
2010/0077842 A1 4/2010 Rosenbaum et al.
2011/0089080 A1 4/2011 Kim et al.
2011/0303585 A1 12/2011 Dath et al.
2011/0315596 A1 12/2011 Prentice et al.
2011/0315597 A1 12/2011 Krishna et al.
2012/0000829 A1 1/2012 Dougherty et al.
2013/0026418 A1 1/2013 Koseoglu
2013/0048537 A1 2/2013 Noh et al.
2013/0092598 A1 4/2013 Joseck et al.
2013/0143778 A1 6/2013 Varadaraj et al.
2013/0146508 A1 6/2013 Quignard et al.
2013/0264246 A1 10/2013 Holtzer et al.
2013/0341243 A1 12/2013 Novak et al.
2014/0197071 A1 7/2014 Prentice et al.
2014/0274827 A1 9/2014 Lyon et al.
2015/0014217 A1 1/2015 Smiley et al.
2015/0152343 A1 6/2015 Vijay et al.
2015/0175911 A1 6/2015 Shih et al.
2015/0218466 A1 8/2015 Prentice et al.
2015/0344807 A1 12/2015 Takeshima
2016/0281009 A1 9/2016 Aubry et al.
2017/0183577 A1 6/2017 Hilbert et al.
2017/0183578 A1 6/2017 Hilbert et al.
2017/0183579 A1 6/2017 Fruchey et al.
2017/0183580 A1 6/2017 Harandi et al.

FOREIGN PATENT DOCUMENTS

EP 0471071 B1 8/1995
EP 1452579 A1 9/2004
GB 1174593 A 12/1969
GB 1216198 A 12/1970
GB 1270438 A 4/1972
GB 1440230 A 6/1976
JP 2004002551 A 1/2004
JP 2004067906 A 3/2004
JP 3866380 B2 1/2007
JP 2007009159 A 1/2007
JP 3999911 B2 10/2007
JP 3999912 B2 10/2007
JP 4072396 B2 4/2008
JP 4152127 B2 9/2008
JP 4268373 B2 5/2009
JP 2009292934 A 12/2009
JP 4482469 B2 6/2010
JP 4482470 B2 6/2010
JP 2010215723 A 9/2010
JP 4563216 B2 10/2010
JP 4567947 B2 10/2010
JP 4567948 B2 10/2010
JP 2010241869 A 10/2010
JP 2010241875 A 10/2010
JP 4575646 B2 11/2010
JP 4593376 B2 12/2010
JP 4620381 B2 1/2011
JP 2012021085 A 2/2012
JP 4994327 B2 8/2012
JP 5043754 B2 10/2012

(56) References Cited

FOREIGN PATENT DOCUMENTS

| | | | |
|---|---|---|---|
| JP | 5052874 | B2 | 10/2012 |
| JP | 5052875 | B2 | 10/2012 |
| JP | 5052876 | B2 | 10/2012 |
| JP | 5128631 | B2 | 1/2013 |
| JP | 5128632 | B2 | 1/2013 |
| JP | 5128633 | B2 | 1/2013 |
| JP | 2013040352 | A | 2/2013 |
| JP | 5166686 | B2 | 3/2013 |
| JP | 5205639 | B2 | 6/2013 |
| JP | 5205640 | B2 | 6/2013 |
| JP | 5205641 | B2 | 6/2013 |
| JP | 5312646 | B2 | 10/2013 |
| JP | 5328973 | B2 | 10/2013 |
| JP | 5361499 | B2 | 12/2013 |
| JP | 5467890 | B2 | 4/2014 |
| JP | 5518454 | B2 | 6/2014 |
| JP | 5520101 | B2 | 6/2014 |
| JP | 5520114 | B2 | 6/2014 |
| JP | 5520115 | B2 | 6/2014 |
| JP | 5615215 | B2 | 10/2014 |
| JP | 5632522 | B2 | 11/2014 |
| JP | 2015113405 | A | 6/2015 |
| JP | 2016008263 | A | 1/2016 |
| KR | 1566581 | B1 | 11/2015 |
| WO | 2004078885 | A1 | 9/2004 |
| WO | 2004093559 | A2 | 11/2004 |
| WO | 2014175952 | A1 | 10/2014 |

OTHER PUBLICATIONS

Laredo, Georgina C. et al., "High quality diesel by hydrotreating of atmospheric gas oil/light cycle oil blends", Fuel, 2004, vol. 83, pp. 1381-1389.

The Partial International Search Report of PCT/US2016/068784 dated Mar. 17, 2017.

The International Search Report and Written Opinion of PCT/US2016/068779 dated Mar. 29, 2017.

The International Search Report and Written Opinion of PCT/US2016/068786 dated Mar. 24, 2017.

The Partial International Search Report of PCT/US2016/068796 dated Mar. 21, 2017.

The Partial International Search Report of PCT/US2016/068803 dated Mar. 15, 2017.

The International Search Report and Written Opinion of PCT/US2016/068806 dated Mar. 21, 2017.

* cited by examiner

| | | | Ref 1 | Ref 2 | Sample I | Sample II | Sample III |
|---|---|---|---|---|---|---|---|
| 2 KV100 | | cSt | 28.13 | 33.42 | 31.08 | 29.45 | 29.97 |
| 3 KV40 | | cSt | 389.6 | 435.2 | 391 | 361.3 | 383.3 |
| 4 VI | | | 99 | 113 | 113 | 113 | 109 |
| 5 CCR | D4530 | | 0.01 | <0.01 | 0.01 | 0.01 | 0.01 |
| 6 Pour Point | D97 | | -18 | -24 | -27 | -15 | -18 |
| 7 Cloud Point | D2500 | | -18 | 6 | -10 | -2 | 6 |
| 8 Cloud Pour Spread | D97-D2500 | | 0 | 30 | 17 | 13 | 24 |
| 9 SimDis, IBP | | | 829 | 842 | 973 | 944 | 937 |
| 10 SimDis, 5% | | | 922 | 966 | 1044 | 1021 | 1020 |
| 11 SimDis, 10% | | | 958 | 1009 | 1061 | 1041 | 1043 |
| 12 SimDis, 30% | | | 1031 | 1092 | 1100 | 1086 | 1090 |
| 13 SimDis, 50% | | | 1079 | 1133 | 1128 | 1115 | 1119 |
| 14 SimDis, 70% | | | 1126 | 1179 | 1161 | 1150 | 1155 |
| 15 SimDis, 90% | | | 1203 | 1263 | 1216 | 1209 | 1213 |
| 16 SimDis, 95% | | | 1443 | 1305 | 1247 | 1242 | 1245 |
| 17 SimDis, FBP | | | 1331 | 1382 | 1320 | 1332 | 1327 |
| 18 Pr + Et | 13C NMR | % | 1.63 | 1.53 | 2.04 | 2.04 | 1.57 |
| 19 T/P Pr | 13C NMR | % | 0.81 | 0.76 | 0.91 | 1.09 | 0.78 |
| 20 T/P Et | 13C NMR | % | 0.82 | 0.77 | 1.13 | 0.95 | 0.79 |
| 21 (Pr + Et)/epsilon | 13C NMR | | 0.127 | 0.101 | 0.161 | 0.136 | 0.090 |
| 22 Pr/epsilon | 13C NMR | | 0.063 | 0.050 | 0.072 | 0.073 | 0.045 |
| 23 Et/epsilon | 13C NMR | | 0.064 | 0.051 | 0.089 | 0.063 | 0.046 |
| 24 Peak Heat Exchange Rate du | DSC | (W/g-°C) | 4.64E-03 | 6.75E-04 | 0.000423 | 0.000809 | 9.42E-04 |
| 25 0 Rings | FDMS - corrected | % | 1.77 | | 0.03 | 0.03 | 0.03 |
| 26 1 Ring | FDMS - corrected | % | 8.39 | | 6.62 | 6.82 | 6.57 |
| 27 2 Rings | FDMS - corrected | % | 15.88 | | 17.65 | 17.57 | 17.38 |
| 28 3 Rings | FDMS - corrected | % | 19.59 | | 21.53 | 21.00 | 20.65 |
| 29 4 Rings | FDMS - corrected | % | 18.85 | | 18.65 | 18.52 | 18.68 |
| 30 5 Rings | FDMS - corrected | % | 14.83 | | 13.33 | 13.26 | 13.91 |
| 31 6 Rings | FDMS - corrected | % | 9.47 | | 8.21 | 8.43 | 8.72 |
| 32 (5+6)/(2+3) | FDMS - corrected | | 0.69 | | 0.55 | 0.56 | 0.59 |
| 33 (1+2+3)/(4+5+6) | FDMS - corrected | | 1.02 | | 1.14 | 1.13 | 1.08 |

FIG. 7

| | | | Ref 1 | Ref 2 | Sample IV | Sample V | Sample VI | Sample II | Sample III |
|---|---|---|---|---|---|---|---|---|---|
| 2 KV100 | | cSt | 28.13 | 33.42 | 25.73 | 26.35 | 30.23 | 30.65 | 26.57 |
| 3 KV40 | | cSt | 389.6 | 435.2 | 320.99 | 336.12 | 402.5 | 416 | 336.7 |
| 4 I | | | 99 | 113 | 104 | 103 | 106 | 104 | 104 |
| 5 CCR | D4530 | | 0.01 | <0.01 | | | 0.03 | | |
| 6 Pour Point | D97 | | -18 | -24 | | -21 | -21 | -15 | |
| 7 Cloud Point | D2500 | | -18 | 6 | | 3 | 9 | 13 | |
| 8 Cloud Pour Spread | D97-D2500 | | 0 | 30 | | 24 | 30 | | |
| 9 SimDis, IBP | | | 829 | 842 | 746 | 768 | 865 | 831 | 753 |
| 10 SimDis, 5% | | | 922 | 966 | 887 | 889 | 938 | 938 | 889 |
| 11 SimDis, 10% | | | 958 | 1009 | 927 | 928 | 967 | 971 | 929 |
| 12 SimDis, 30% | | | 1031 | 1092 | 1006 | 1007 | 1032 | 1040 | 1010 |
| 13 SimDis, 50% | | | 1079 | 1133 | 1064 | 1065 | 1085 | 1093 | 1069 |
| 14 SimDis, 70% | | | 1126 | 1179 | 1127 | 1128 | 1143 | 1150 | 1134 |
| 15 SimDis, 90% | | | 1203 | 1263 | 1227 | 1229 | 1242 | 1248 | 1244 |
| 16 SimDis, 95% | | | 1443 | 1305 | 1279 | 1281 | 1291 | 1296 | 1302 |
| 17 SimDis, FBP | | | 1331 | 1382 | 1362 | 1358 | 1364 | 1367 | 1382 |
| 18 Pr + Et | 13C NMR | % | 1.63 | 1.53 | 1.81 | 1.88 | 1.71 | 1.73 | 1.59 |
| 19 T/P Pr | 13C NMR | % | 0.81 | 0.76 | 0.88 | 0.91 | 0.83 | 0.86 | 0.81 |
| 20 T/P Et | 13C NMR | % | 0.82 | 0.77 | 0.93 | 0.97 | 0.88 | 0.87 | 0.78 |
| 21 (Pr + Et)/epsilon | 13C NMR | | 0.127 | 0.101 | 0.134 | 0.133 | 0.124 | 0.117 | 0.107 |
| 22 Pr/epsilon | 13C NMR | | 0.063 | 0.050 | 0.065 | 0.064 | 0.060 | 0.058 | 0.055 |
| 23 Et/epsilon | 13C NMR | | 0.064 | 0.051 | 0.069 | 0.069 | 0.064 | 0.059 | 0.053 |
| 24 Peak Heat Exchange Ra | DSC | (W/g-°C) | 4.64E-03 | 6.75E-04 | 0.0013 | 0.00056 | 5.39E-04 | 7.82E-04 | 6.17E-04 |
| 25 0 Rings | FDMS - corrected | % | 1.77 | | 1.86 | 1.47 | 2.18 | 2.37 | 1.86 |
| 26 1 Ring | FDMS - corrected | % | 8.39 | | 11.90 | 13.30 | 10.31 | 10.66 | 10.66 |
| 27 2 Rings | FDMS - corrected | % | 15.88 | | 20.75 | 23.32 | 18.21 | 18.26 | 19.83 |
| 28 3 Rings | FDMS - corrected | % | 19.59 | | 21.97 | 22.95 | 20.83 | 20.29 | 21.87 |
| 29 4 Rings | FDMS - corrected | % | 18.85 | | 17.05 | 16.25 | 18.02 | 17.59 | 17.85 |
| 30 5 Rings | FDMS - corrected | % | 14.83 | | 10.90 | 9.30 | 13.08 | 12.95 | 11.90 |
| 31 6 Rings | FDMS - corrected | % | 9.47 | | 6.30 | 4.30 | 8.31 | 8.37 | 7.20 |
| 32 (5+6)/(2+3) | FDMS - corrected | | 0.69 | | 0.40 | 0.29 | 0.55 | 0.55 | 0.46 |
| 33 (1+2+3)/(4+5+6) | FDMS - corrected | | 1.02 | | 1.59 | 2.00 | 1.25 | 1.26 | 1.42 |

FIG. 8

| | Base Stock Character | Test Method | Units | Ref 1 | Sample A | Sample B | Sample C | Sample D | Sample E | Sample F | Sample G |
|---|---|---|---|---|---|---|---|---|---|---|---|
| 2 | KV100 | | cSt | 28.13 | 30.4 | 30.4 | 32.5 | 30.8 | 30 | 31 | 31.7 |
| 3 | KV40 | | cSt | 389.6 | 405.2 | 405.2 | 438.7 | 423.6 | 395.8 | 436.3 | 450.8 |
| 4 | VI | | | 99 | 106 | 106 | 108 | 103 | 106 | 102 | 101 |
| 5 | CCR | D4530 | wt% | 0.01 | <0.001 | 0 | 0.01 | 0.09 | 0.39 | 0.45 | |
| 6 | Turbidity | | ntu | 0.53 | 2.7 | 2.86 | 4.25 | 3.56 | | | |
| 7 | Pour Point | D97 | C | -18 | -33 | -27 | | -24 | -18 | -24 | -31* |
| 8 | Cloud Point | D2500 | C | -18 | -14 | -14 | | -3 | 8.6* | 6* | 8.6* |
| 9 | Cloud Pour Spread | D97-D2500 | C | 0 | 19 | 13 | 0 | 21 | | | |
| 10 | Total Saturates | D7419 | % | 99.6% | | | 0.997 | | | | |
| 11 | SimDis, IBP | M1567 | F | 829 | 934 | 862 | 935 | 895 | 867 | 876 | 837 |
| 12 | SimDis, 5% | | F | 922 | 987 | 986 | 995 | 946 | 948 | 943 | 913 |
| 13 | SimDis, 10% | | F | 958 | 1008 | 1008 | 1017 | 971 | 974 | 970 | 947 |
| 14 | SimDis, 30% | | F | 1031 | 1056 | 1058 | 1069 | 1031 | 1034 | 1031 | 1026 |
| 15 | SimDis, 50% | | F | 1079 | 1097 | 1099 | 1113 | 1082 | 1086 | 1082 | 1086 |
| 16 | SimDis, 70% | | F | 1126 | 1143 | 1146 | 1165 | 1139 | 1144 | 1139 | 1145 |
| 17 | SimDis, 90% | | F | 1203 | 1226 | 1229 | 1250 | 1239 | 1244 | 1238 | 1240 |
| 18 | SimDis, 95% | | F | 1443 | 1272 | 1273 | 1295 | 1288 | 1292 | 1287 | 1287 |
| 19 | SimDis, FBP | | F | 1331 | 1360 | 1358 | 1365 | 1364 | 1358 | 1366 | 1360 |
| 20 | Pr + Et | 13C NMR | % | 1.56 | 2.37 | 2.25 | 2.06 | 1.67 | 1.52 | 1.65 | 1.62 |
| 21 | T/P Pr | 13C NMR | % | 0.74 | 1.05 | 1.00 | 0.95 | 0.69 | 0.82 | 0.84 | 0.84 |
| 22 | T/P Et | 13C NMR | % | 0.82 | 1.32 | 1.25 | 1.11 | 0.98 | 0.70 | 0.81 | 0.78 |
| 23 | (Pr + Et)/epsilon | 13C NMR | | 0.1 | 0.192 | 0.227 | 0.193 | 0.100 | 0.090 | 0.114 | 0.103 |
| 24 | Pr/epsilon | 13C NMR | | 0.047 | 0.085 | 0.101 | 0.089 | 0.042 | 0.048 | 0.058 | 0.053 |
| 25 | Et/epsilon | 13C NMR | | 0.053 | 0.107 | 0.126 | 0.104 | 0.059 | 0.041 | 0.056 | 0.050 |
| 26 | epsilon | | % | 16.23 | 12.350 | 9.930 | 10.67 | 16.580 | 16.930 | 14.520 | 15.750 |

FIG. 12

| | Base Stock Character | Test Method | Units | Ref 1 | Sample A | Sample B | Sample C | Sample D | Sample E | Sample F | Sample G |
|---|---|---|---|---|---|---|---|---|---|---|---|
| 28 | 1 Ring | FTICR-MS | % | 11.34 | 13.50 | | 12.55 | 13.80 | 16.17 | 12.07 | 14.13 |
| 29 | 2 Rings | FTICR-MS | % | 18.01 | 20.07 | | 21.77 | 17.30 | 17.66 | 15.33 | 14.69 |
| 30 | 3 Rings | FTICR-MS | % | 19.70 | 20.62 | | 21.66 | 16.69 | 16.69 | 16.57 | 15.05 |
| 31 | 4 Rings | FTICR-MS | % | 17.35 | 16.49 | | 16.93 | 14.46 | 14.20 | 14.65 | 13.02 |
| 32 | 5 Rings | FTICR-MS | % | 13.44 | 11.45 | | 11.52 | 11.24 | 10.62 | 11.93 | 11.21 |
| 33 | 6 Rings | FTICR-MS | % | 8.93 | 6.82 | | 6.78 | 8.16 | 7.19 | 8.90 | 8.35 |
| 34 | 7 Rings | FTICR-MS | % | 4.79 | 3.56 | | 3.00 | 5.13 | 4.29 | 5.54 | 6.07 |
| 35 | 8 Rings | FTICR-MS | % | 2.06 | 1.80 | | 1.15 | 3.56 | 2.43 | 4.54 | 4.38 |
| 36 | 9 Rings | FTICR-MS | % | 0.35 | 0.66 | | 0.20 | 1.73 | 0.98 | 2.84 | 2.73 |
| 41 | 5+ | FTICR-MS | % | 29.66 | 24.35 | | 22.64 | 30.67 | 25.57 | 35.87 | 35.16 |
| 42 | 6+ | FTICR-MS | % | 16.22 | 12.90 | | 11.12 | 19.43 | 14.95 | 23.94 | 23.95 |
| 43 | 7+ | FTICR-MS | % | 7.29 | 6.09 | | 4.35 | 11.27 | 7.76 | 15.04 | 15.59 |
| | 8+ | FTICR-MS | % | 2.50 | 2.53 | | 1.35 | 6.14 | 3.47 | 9.50 | 9.53 |
| | 9+ | FTICR-MS | % | 0.43 | 0.73 | | 0.20 | 2.59 | 1.04 | 4.96 | 5.14 |
| 44 | 11+ | FTICR-MS | % | 0.02 | 0.00 | | 0 | 0.23 | 0.03 | 0.75 | 0.90 |
| | 5+/2 | FTICR-MS | | 1.65 | 1.21 | | 1.04 | 1.77 | 1.45 | 2.34 | 2.39 |
| 45 | 6+/2 | FTICR-MS | | 0.90 | 0.64 | | 0.51 | 1.12 | 0.85 | 1.56 | 1.63 |
| | 7+/2 | FTICR-MS | | 0.40 | 0.30 | | 0.20 | 0.65 | 0.44 | 0.98 | 1.06 |
| 46 | 0 Rings | FDMS - correc | % | 3.24 | 3.62 | | 4.70 | 4.88 | 7.50 | | 7.33 |
| 47 | 1 Ring | FDMS - correc | % | 10.05 | 9.08 | | 11.32 | 11.01 | 12.34 | | 12.09 |
| 48 | 2 Rings | FDMS - correc | % | 15.64 | 17.71 | | 18.87 | 16.43 | 15.96 | | 14.51 |
| 49 | 3 Rings | FDMS - correc | % | 19.41 | 22.05 | | 22.55 | 17.95 | 17.39 | | 14.61 |
| 50 | 4 Rings | FDMS - correc | % | 19.38 | 19.77 | | 19.24 | 16.51 | 16.67 | | 14.48 |
| 51 | 5 Rings | FDMS - correc | % | 15.85 | 14.25 | | 13.39 | 13.74 | 14.24 | | 13.36 |
| 52 | 6 Rings | FDMS - correc | % | 10.29 | 9.07 | | 8.03 | 10.52 | 11.19 | | 11.32 |
| 53 | 7 Rings | FDMS - correc | % | 3.93 | 2.59 | | 1.12 | 3.54 | 1.99 | | 3.15 |
| 54 | 8 Rings | FDMS - correc | % | 1.83 | 1.21 | | 0.60 | 2.84 | 1.70 | | 3.61 |
| 55 | 9 Rings | FDMS - correc | % | 0.31 | 0.59 | | 0.17 | 1.64 | 0.94 | | 2.63 |
| 56 | 9+ | FDMS - correc | % | 0.39 | 0.66 | | 0.17 | 2.58 | 1.03 | | 5.54 |
| 57 | 6+ | FDMS - correc | % | 16.43 | 13.53 | | 9.92 | 19.47 | 15.90 | | 23.62 |
| 58 | (2+3)/1 | FDMS - corrected | | 3.49 | 4.38 | | 3.66 | 3.12 | 2.70 | | 2.41 |
| 59 | (1+2+3)/(4+5+6) | FDMS - corrected | | 0.99 | 1.13 | | 1.30 | 1.11 | 1.09 | | 1.05 |

FIG. 13

BRIGHT STOCK PRODUCTION FROM DEASPHALTED OIL

CROSS-REFERENCE TO RELATED APPLICATIONS

This application claims priority to U.S. Provisional Application Ser. No. 62/271,543 filed Dec. 28, 2015, which is herein incorporated by reference in its entirety.

This application is related to five (5) other co-pending U.S. applications, filed on even date herewith, and identified by the following titles: entitled "Bright Stock And Heavy Neutral Production From Resid Deasphalting"; entitled "Bright Stock Production From Low Severity Resid Deasphalting"; entitled "Bright Stock Production From Low Severity Resid Deasphalting"; entitled "Integrated Resid Deasphalting And Gasification" and entitled "Sequential Deasphalting For Base Stock Production". Each of these co-pending US applications is hereby incorporated by references herein in their entirety.

FIELD

Compositions are provided for lubricant oil base stocks derived from deasphalted oils produced by low severity deasphalting of resid fractions.

BACKGROUND

Lubricant base stocks are one of the higher value products that can be generated from a crude oil or crude oil fraction. The ability to generate lubricant base stocks of a desired quality is often constrained by the availability of a suitable feedstock. For example, most conventional processes for lubricant base stock production involve starting with a crude fraction that has not been previously processed under severe conditions, such as a vacuum gas oil fraction from a crude with moderate to low levels of initial sulfur content.

In some situations, a deasphalted oil formed by propane desaphalting of a vacuum resid can be used for additional lubricant base stock production. Deasphalted oils can potentially be suitable for production of heavier base stocks, such as bright stocks. However, the severity of propane deasphalting required in order to make a suitable feed for lubricant base stock production typically results in a yield of only about 30 wt % deasphalted oil relative to the vacuum resid feed.

U.S. Pat. No. 3,414,506 describes methods for making lubricating oils by hydrotreating pentane-alcohol-deasphalted short residue. The methods include performing deasphalting on a vacuum resid fraction with a deasphalting solvent comprising a mixture of an alkane, such as pentane, and one or more short chain alcohols, such as methanol and isopropyl alcohol. The deasphalted oil is then hydrotreated, followed by solvent extraction to perform sufficient VI uplift to form lubricating oils.

U.S. Pat. No. 7,776,206 describes methods for catalytically processing resids and/or deasphalted oils to form bright stock. A resid-derived stream, such as a deasphalted oil, is hydroprocessed to reduce the sulfur content to less than 1 wt % and reduce the nitrogen content to less than 0.5 wt %. The hydroprocessed stream is then fractionated to form a heavier fraction and a lighter fraction at a cut point between 1150° F.-1300° F. (620° C.-705° C.). The lighter fraction is then catalytically processed in various manners to form a bright stock.

SUMMARY

In various aspects, lubricant base stock compositions are provided. The compositions can include one or more of a T10 distillation point of at least 900° F. (482° C.), a viscosity index of at least 80; a saturates content of at least 90 wt %; a sulfur content of less than 300 wppm; a kinematic viscosity at 100° C. of at least 14 cSt; a kinematic viscosity at 40° C. of at least 320 cSt; and a sum of terminal/pendant propyl groups and terminal/pendant ethyl groups of at least 1.7 per 100 carbon atoms of the composition. The compositions can additionally or alternately include one or more additional compositional properties related to branching of molecules and/or numbers of saturated rings in molecules within the composition.

BRIEF DESCRIPTION OF THE DRAWINGS

FIG. 7 shows properties of lubricant base stocks made from various propane deasphalted feeds and reference base stocks.

FIG. 8 shows properties of lubricant base stocks made from various butane deasphalted feeds.

FIG. 12 shows properties of lubricant base stocks made from various pentane deasphalted feeds.

FIG. 13 shows properties of lubricant base stocks made from various pentane deasphalted feeds.

DETAILED DESCRIPTION

Figure 1:
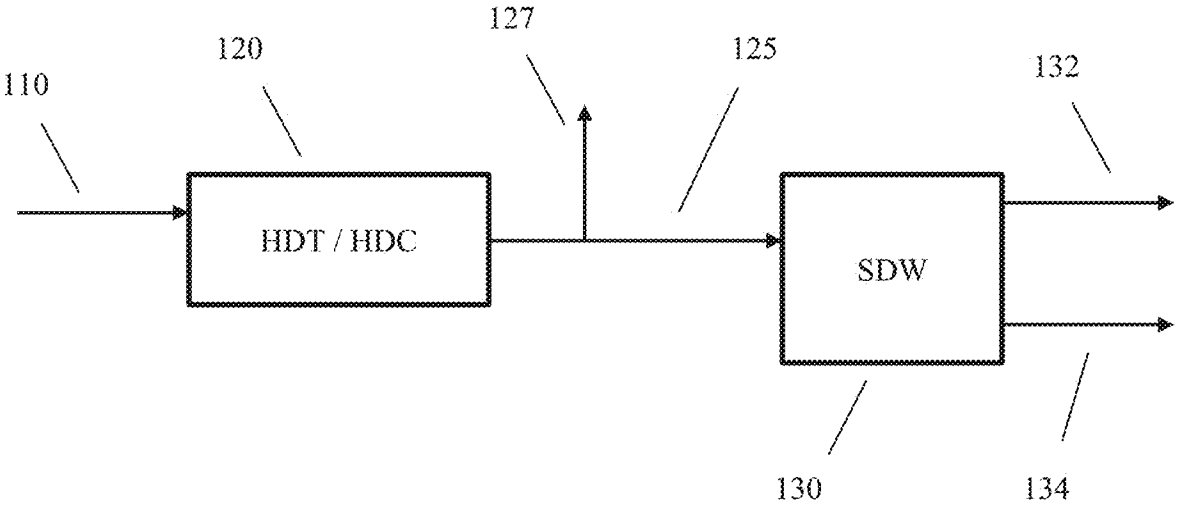
FIG. 1 schematically shows an example of a configuration for processing a deasphalted oil to form a lubricant base stock.

All numerical values within the detailed description and the claims herein are modified by "about" or "approximately" the indicated value, and take into account experimental error and variations that would be expected by a person having ordinary skill in the art.

Overview

In various aspects, methods are provided for producing Group I and Group II lubricant base stocks, including Group I and Group II bright stock, from deasphalted oils generated by low severity $C_{4+}$ deasphalting. Low severity deasphalting as used herein refers to deasphalting under conditions that result in a high yield of deasphalted oil (and/or a reduced amount of rejected asphalt or rock), such as a deasphalted oil yield of at least 50 wt % relative to the feed to deasphalting, or at least 55 wt %, or at least 60 wt %, or at least 65 wt %, or at least 70 wt %, or at least 75 wt %. The Group I base stocks (including bright stock) can be formed without performing a solvent extraction on the deasphalted oil. The Group II base stocks (including bright stock) can be formed using a combination of catalytic and solvent processing. In contrast with conventional bright stock produced from deasphalted oil formed at low severity conditions, the Group I and Group II bright stock described herein can be substantially free from haze after storage for extended periods of time. This haze free Group II bright stock can correspond to a bright stock with an unexpected composition.

In various additional aspects, methods are provided for catalytic processing of $C_3$ deasphalted oils to form Group II bright stock. Forming Group II bright stock by catalytic processing can provide a bright stock with unexpected compositional properties.

Conventionally, crude oils are often described as being composed of a variety of boiling ranges. Lower boiling range compounds in a crude oil correspond to naphtha or kerosene fuels. Intermediate boiling range distillate compounds can be used as diesel fuel or as lubricant base stocks. If any higher boiling range compounds are present in a crude oil, such compounds are considered as residual or "resid" compounds, corresponding to the portion of a crude oil that is left over after performing atmospheric and/or vacuum distillation on the crude oil.

In some conventional processing schemes, a resid fraction can be deasphalted, with the deasphalted oil used as part of a feed for forming lubricant base stocks. In conventional processing schemes a deasphalted oil used as feed for forming lubricant base stocks is produced using propane deasphalting. This propane deasphalting corresponds to a "high severity" deasphalting, as indicated by a typical yield of deasphalted oil of about 40 wt % or less, often 30 wt % or less, relative to the initial resid fraction. In a typical lubricant base stock production process, the deasphalted oil can then be solvent extracted to reduce the aromatics content, followed by solvent dewaxing to form a base stock. The low yield of deasphalted oil is based in part on the inability of conventional methods to produce lubricant base stocks from lower severity deasphalting that do not form haze over time.

In some aspects, it has been discovered that using a mixture of catalytic processing, such as hydrotreatment, and solvent processing, such as solvent dewaxing, can be used to produce lubricant base stocks from deasphalted oil while also producing base stocks that have little or no tendency to form haze over extended periods of time. The deasphalted oil can be produced by deasphalting process that uses a $C_4$ solvent, a $C_5$ solvent, a $C_{6+}$ solvent, a mixture of two or more $C_{4+}$ solvents, or a mixture of two or more $C_{5+}$ solvents. The deasphalting process can further correspond to a process with a yield of deasphalted oil of at least 50 wt % for a vacuum resid feed having a T10 distillation point (or optionally a T5 distillation point) of at least 400° C., or at least 510° C., or a deasphalted oil yield of at least 60 wt %, or at least 65 wt %, or at least 70 wt %, or at least 75 wt %. It is believed that the reduced haze formation is due in part to the reduced or minimized differential between the pour point and the cloud point for the base stocks and/or due in part to forming a bright stock with a cloud point of −2° C. or less, or −5° C. or less.

For production of Group I base stocks, a deasphalted oil can be hydroprocessed (hydrotreated and/or hydrocracked) under conditions sufficient to achieve a desired viscosity index increase for resulting base stock products. The hydroprocessed effluent can be fractionated to separate lower boiling portions from a lubricant base stock boiling range portion. The lubricant base stock boiling range portion can then be solvent dewaxed to produce a dewaxed effluent. The dewaxed effluent can be separated to form a plurality of base stocks with a reduced tendency (such as no tendency) to form haze over time.

For production of Group II base stocks, in some aspects a deasphalted oil can be hydroprocessed (hydrotreated and/or hydrocracked), so that ~700° F.+ (370° C.+) conversion is 10 wt % to 40 wt %. The hydroprocessed effluent can be fractionated to separate lower boiling portions from a lubricant base stock boiling range portion. The lubricant boiling range portion can then be hydrocracked, dewaxed, and hydrofinished to produce a catalytically dewaxed effluent. Optionally but preferably, the lubricant boiling range portion can be underdewaxed, so that the wax content of the catalytically dewaxed heavier portion or potential bright stock portion of the effluent is at least 6 wt %, or at least 8 wt %, or at least 10 wt %. This underdewaxing can also be suitable for forming light or medium or heavy neutral lubricant base stocks that do not require further solvent upgrading to form haze free base stocks. In this discussion, the heavier portion/potential bright stock portion can roughly correspond to a 538° C.+ portion of the dewaxed effluent. The catalytically dewaxed heavier portion of the effluent can then be solvent processed by solvent dewaxing to form a solvent dewaxed effluent. The solvent dewaxed effluent can be separated to form a plurality of base stocks with a reduced tendency (such as no tendency) to form haze over time, including at least a portion of a Group II bright stock product.

For production of Group II base stocks, in other aspects a deasphalted oil can be hydroprocessed (hydrotreated and/or hydrocracked), so that 370° C.+ conversion is at least 40 wt %, or at least 50 wt %. The hydroprocessed effluent can be fractionated to separate lower boiling portions from a lubricant base stock boiling range portion. The lubricant base stock boiling range portion can then be hydrocracked, dewaxed, and hydrofinished to produce a catalytically dewaxed effluent. The catalytically dewaxed effluent can then be solvent extracted to form a raffinate. The raffinate can be separated to form a plurality of base stocks with a reduced tendency (such as no tendency) to form haze over time, including at least a portion of a Group II bright stock product. In yet other aspects, a Group II bright stock product can be formed without performing further solvent processing after catalytic dewaxing.

In other aspects, it has been discovered that catalytic processing can be used to produce Group II bright stock with unexpected compositional properties from $C_3$, $C_4$, $C_5$, and/or $C_{5+}$ deasphalted oil. The deasphalted oil can be hydrotreated to reduce the content of heteroatoms (such as sulfur and nitrogen), followed by catalytic dewaxing under sweet conditions. Optionally, hydrocracking can be included as part of the sour hydrotreatment stage and/or as part of the sweet dewaxing stage.

In various aspects, a variety of combinations of catalytic and/or solvent processing can be used to form lubricant base stocks, including Group II bright stock, from deasphalted oils. These combinations include, but are not limited to:

a) Hydroprocessing of a deasphalted oil under sour conditions (i.e., sulfur content of at least 500 wppm); separation of the hydroprocessed effluent to form at least a lubricant boiling range fraction, and solvent dewaxing of the lubricant boiling range fraction. In some aspects, the hydroprocessing of the deasphalted oil can correspond to hydrotreatment, hydrocracking, or a combination thereof.

b) Hydroprocessing of a deasphalted oil under sour conditions (i.e., sulfur content of at least 500 wppm); separation of the hydroprocessed effluent to form at least a lubricant boiling range fraction; and catalytic dewaxing of the lubricant boiling range fraction under sweet conditions (i.e., 500 wppm or less sulfur). The catalytic dewaxing can optionally correspond to catalytic dewaxing using a dewaxing catalyst with a pore size greater than 8.4 Angstroms. Optionally, the sweet processing conditions can further include hydrocracking, noble metal hydrotreatment, and/or hydrofinishing. The optional hydrocracking, noble metal hydrotreatment, and/or hydrofinishing can occur prior to and/or after or after catalytic dewaxing. For example, the order of catalytic processing under sweet processing conditions can be noble metal hydrotreating followed by hydrocracking followed by catalytic dewaxing.

c) The process of b) above, followed by performing an additional separation on at least a portion of the catalytically dewaxed effluent. The additional separation can correspond to solvent dewaxing, solvent extraction (such as solvent extraction with furfural or n-methylpyrollidone), a physical separation such as ultracentrifugation, or a combination thereof.

d) The process of a) above, followed by catalytic dewaxing (sweet conditions) of at least a portion of the solvent dewaxed product. Optionally, the sweet processing conditions can further include hydrotreating (such as noble metal hydrotreating), hydrocracking and/or hydrofinishing. The additional sweet hydroprocessing can be performed prior to and/or after the catalytic dewaxing.

Group I base stocks or base oils are defined as base stocks with less than 90 wt % saturated molecules and/or at least 0.03 wt % sulfur content. Group I base stocks also have a viscosity index (VI) of at least 80 but less than 120. Group II base stocks or base oils contain at least 90 wt % saturated molecules and less than 0.03 wt % sulfur. Group II base stocks also have a viscosity index of at least 80 but less than 120. Group III base stocks or base oils contain at least 90 wt % saturated molecules and less than 0.03 wt % sulfur, with a viscosity index of at least 120.

In some aspects, a Group III base stock as described herein may correspond to a Group III+ base stock. Although a generally accepted definition is not available, a Group III+ base stock can generally correspond to a base stock that satisfies the requirements for a Group III base stock while also having at least one property that is enhanced relative to a Group III specification. The enhanced property can correspond to, for example, having a viscosity index that is substantially greater than the required specification of 120, such as a Group III base stock having a VI of at least 130, or at least 135, or at least 140. Similarly, in some aspects, a Group II base stock as described herein may correspond to a Group II+ base stock. Although a generally accepted definition is not available, a Group II+ base stock can generally correspond to a base stock that satisfies the requirements for a Group II base stock while also having at least one property that is enhanced relative to a Group II specification. The enhanced property can correspond to, for example, having a viscosity index that is substantially greater than the required specification of 80, such as a Group II base stock having a VI of at least 103, or at least 108, or at least 113.

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, conditions may be provided for various types of hydroprocessing of feeds or effluents. Examples of hydroprocessing can include, but are not limited to, one or more of hydrotreating, hydrocracking, catalytic dewaxing, and hydrofinishing/aromatic saturation. Such hydroprocessing conditions can be controlled to have desired values for the conditions (e.g., temperature, pressure, LHSV, treat gas rate) by using at least one controller, such as a plurality of controllers, to control one or more of the hydroprocessing conditions. In some aspects, for a given type of hydroprocessing, at least one controller can be associated with each type of hydroprocessing condition. In some aspects, one or more of the hydroprocessing conditions can be controlled by an associated controller. Examples of structures that can be controlled by a controller can include, but are not limited to, valves that control a flow rate, a pressure, or a combination thereof; heat exchangers and/or heaters that control a temperature; and one or more flow meters and one or more associated valves that control relative flow rates of at least two flows. Such controllers can optionally include a controller feedback loop including at least a processor, a detector for detecting a value of a control variable (e.g., temperature, pressure, flow rate, and a processor output for controlling the value of a manipulated variable (e.g., changing the position of a valve, increasing or decreasing the duty cycle and/or temperature for a heater). Optionally, at least one hydroprocessing condition for a given type of hydroprocessing may not have an associated controller.

In this discussion, unless otherwise specified a lubricant boiling range fraction corresponds to a fraction having an initial boiling point or alternatively a T5 boiling point of at least about 370° C. (~700° F.). A distillate fuel boiling range fraction, such as a diesel product fraction, corresponds to a fraction having a boiling range from about 193° C. (375° F.) to about 370° C. (~700° F.). Thus, distillate fuel boiling range fractions (such as distillate fuel product fractions) can have initial boiling points (or alternatively T5 boiling points) of at least about 193° C. and final boiling points (or alternatively T95 boiling points) of about 370° C. or less. A naphtha boiling range fraction corresponds to a fraction having a boiling range from about 36° C. (122° F.) to about 193° C. (375° F.) to about 370° C. (~700° F.). Thus, naphtha fuel product fractions can have initial boiling points (or alternatively T5 boiling points) of at least about 36° C. and final boiling points (or alternatively T95 boiling points) of about 193° C. or less. It is noted that 36° C. roughly corresponds to a boiling point for the various isomers of a C5 alkane. A fuels boiling range fraction can correspond to a distillate fuel boiling range fraction, a naphtha boiling range fraction, or a fraction that includes both distillate fuel boiling range and naphtha boiling range components. Light ends are defined as products with boiling points below about 36° C. which include various C1-C4 compounds. When determining a boiling point or a boiling range for a feed or product fraction, an appropriate ASTM test method can be used, such as the procedures described in ASTM D2887, D2892, and/or D86. Preferably, ASTM D2887 should be used unless a sample is not appropriate for characterization based on ASTM D2887. For example, for samples that will not completely elute from a chromatographic column, ASTM D7169 can be used.

Feedstocks

In various aspects, at least a portion of a feedstock for processing as described herein can correspond to a vacuum resid fraction or another type 950° F.+ (510° C.+) or 1000° F.+ (538° C.+) fraction. Another example of a method for forming a 950° F.+ (510° C.+) or 1000° F.+ (538° C.+) fraction is to perform a high temperature flash separation. The 950° F.+ (510° C.+) or 1000° F.+ (538° C.+) fraction formed from the high temperature flash can be processed in a manner similar to a vacuum resid.

A vacuum resid fraction or a 950° F.+ (510° C.+) fraction formed by another process (such as a flash fractionation bottoms or a bitumen fraction) can be deasphalted at low severity to form a deasphalted oil. Optionally, the feedstock can also include a portion of a conventional feed for lubricant base stock production, such as a vacuum gas oil.

A vacuum resid (or other 510° C.+) fraction can correspond to a fraction with a T5 distillation point (ASTM D2892, or ASTM D7169 if the fraction will not completely elute from a chromatographic system) of at least about 900° F. (482° C.), or at least 950° F. (510° C.), or at least 1000° F. (538° C.). Alternatively, a vacuum resid fraction can be characterized based on a T10 distillation point (ASTM D2892/D7169) of at least about 900° F. (482° C.), or at least 950° F. (510° C.), or at least 1000° F. (538° C.).

Resid (or other 510° C.+) fractions can be high in metals. For example, a resid fraction can be high in total nickel, vanadium and iron contents. In an aspect, a resid fraction can contain at least 0.00005 grams of Ni/V/Fe (50 wppm) or at least 0.0002 grams of Ni/V/Fe (200 wppm) per gram of resid, on a total elemental basis of nickel, vanadium and iron. In other aspects, the heavy oil can contain at least 500 wppm of nickel, vanadium, and iron, such as up to 1000 wppm or more.

Contaminants such as nitrogen and sulfur are typically found in resid (or other 510° C.+) fractions, often in organically-bound form. Nitrogen content can range from about 50 wppm to about 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be at least about 5 wt %, such as at least about 10 wt % or at least about 20 wt %. Additionally or alternately, the Conradson carbon residue of a resid fraction can be about 50 wt % or less, such as about 40 wt % or less or about 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of at least 343° C. and a T95 distillation point of 566° C. or less; or a T10 distillation point of at least 343° C. and a T90 distillation point of 566° C. or less; or a T5 distillation point of at least 370° C. and a T95 distillation point of 566° C. or less; or a T5 distillation point of at least 343° C. and a T95 distillation point of 538° C. or less.

Solvent Deasphalting

Solvent deasphalting is a solvent extraction process. In some aspects, suitable solvents for methods as described herein include alkanes or other hydrocarbons (such as alkenes) containing 4 to 7 carbons per molecule. Examples of suitable solvents include n-butane, isobutane, n-pentane, $C_{4+}$ alkanes, $C_{5+}$ alkanes, $C_{4+}$ hydrocarbons, and $C_{5+}$ hydrocarbons. In other aspects, suitable solvents can include $C_3$ hydrocarbons, such as propane. In such other aspects, examples of suitable solvents include propane, n-butane, isobutane, n-pentane, $C_{3+}$ alkanes, $C_{4+}$ alkanes, $C_{5+}$ alkanes, $C_{3+}$ hydrocarbons, $C_{4+}$ hydrocarbons, and $C_{5+}$ hydrocarbons In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent include n-butane and isobutane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %). In aspects where the deasphalting solvent corresponds to a $C_{3+}$ deasphalting solvent, the $C_{3+}$ deasphalting solvent can include less than 10 wt % ethane and/or other $C_2$ hydrocarbons, or less than 5 wt %, or the $C_{3+}$ deasphalting solvent can be substantially free of ethane and/or other $C_2$ hydrocarbons (less than 1 wt %).

Deasphalting of heavy hydrocarbons, such as vacuum resids, is known in the art and practiced commercially. A deasphalting process typically corresponds to contacting a heavy hydrocarbon with an alkane solvent (propane, butane, pentane, hexane, heptane etc and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from about 1:2 to about 1:10, such as about 1:8 or less. Typical solvent deasphalting temperatures range from 40° C. to 200° C., or 40° C. to 150° C., depending on the nature of the feed and the solvent. The pressure during solvent deasphalting can be from about 50 psig (345 kPag) to about 500 psig (3447 kPag).

It is noted that the above solvent deasphalting conditions represent a general range, and the conditions will vary depending on the feed. For example, under typical deasphalting conditions, increasing the temperature can tend to reduce the yield while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In aspects where a $C_3$ deasphalting solvent is used, the yield from solvent deasphalting can be 40 wt % or less. In some aspects, $C_4$ deasphalting can be performed with a yield of deasphalted oil of 50 wt % or less, or 40 wt % or less. In various aspects, the yield of deasphalted oil from solvent deasphalting with a $C_{4+}$ solvent can be at least 50 wt % relative to the weight of the feed to deasphalting, or at least 55 wt %, or at least 60 wt % or at least 65 wt %, or at least 70 wt %. In aspects where the feed to deasphalting includes a vacuum gas oil portion, the yield from solvent deasphalting can be characterized based on a yield by weight of a 950° F.+ (510° C.) portion of the deasphalted oil relative to the weight of a 510° C.+ portion of the feed. In such aspects where a $C_{4+}$ solvent is used, the yield of 510° C.+ deasphalted oil from solvent deasphalting can be at least 40 wt % relative to the weight of the 510° C.+ portion of the feed to deasphalting, or at least 50 wt %, or at least 55 wt %, or at least 60 wt % or at least 65 wt %, or at least 70 wt %. In such aspects where a $C_{4+}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less.

Hydrotreating and Hydrocracking

After deasphalting, the deasphalted oil (and any additional fractions combined with the deasphalted oil) can undergo further processing to form lubricant base stocks. This can include hydrotreatment and/or hydrocracking to remove heteroatoms to desired levels, reduce Conradson Carbon content, and/or provide viscosity index (VI) uplift. Depending on the aspect, a deasphalted oil can be hydroprocessed by hydrotreating, hydrocracking, or hydrotreating and hydrocracking.

The deasphalted oil can be hydrotreated and/or hydrocracked with little or no solvent extraction being performed prior to and/or after the deasphalting. As a result, the deasphalted oil feed for hydrotreatment and/or hydrocracking can have a substantial aromatics content. In various aspects, the aromatics content of the deasphalted oil feed can be at least 50 wt %, or at least 55 wt %, or at least 60 wt %, or at least 65 wt %, or at least 70 wt %, or at least 75 wt %, such as up to 90 wt % or more. Additionally or alternately, the saturates content of the deasphalted oil feed can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419.

The reaction conditions during demetallization and/or hydrotreatment and/or hydrocracking of the deasphalted oil (and optional vacuum gas oil co-feed) can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages for the deasphalted oil. Suitable amounts of conversion of molecules boiling above 1050° F. (566° C.) to molecules boiling below 566° C. include 30 wt % to 90 wt % conversion relative to 566° C., or 30 wt % to 80 wt %, or 30 wt % to 70 wt %, or 40 wt % to 90 wt %, or 40 wt % to 80 wt %, or 40 wt % to 70 wt %, or 50 wt % to 90 wt %, or 50 wt % to 80 wt %, or 50 wt % to 70 wt %. In particular, the amount of conversion relative to 566° C. can be 30 wt % to 90 wt %, or 30 wt % to 70 wt %, or 50 wt % to 90 wt %. Additionally or alternately, suitable amounts of conversion of molecules boiling above ~700° F. (370° C.) to molecules boiling below 370° C. include 10 wt % to 70 wt % conversion relative to 370° C., or 10 wt % to 60 wt %, or 10 wt % to 50 wt %, or 20 wt % to 70 wt %, or 20 wt % to 60 wt %, or 20 wt % to 50 wt %, or 30 wt % to 70 wt %, or 30 wt % to 60 wt %, or 30 wt % to 50 wt %. In particular, the amount of conversion relative to 370° C. can be 10 wt % to 70 wt %, or 20 wt % to 50 wt %, or 30 wt % to 60 wt %.

The hydroprocessed deasphalted oil can also be characterized based on the product quality. After hydroprocessing (hydrotreating and/or hydrocracking), the hydroprocessed deasphalted oil can have a sulfur content of 200 wppm or less, or 100 wppm or less, or 50 wppm or less (such as down to ~0 wppm). Additionally or alternately, the hydroprocessed deasphalted oil can have a nitrogen content of 200 wppm or less, or 100 wppm or less, or 50 wppm or less (such as down to ~0 wppm). Additionally or alternately, the hydroprocessed deasphalted oil can have a Conradson Carbon residue content of 1.5 wt % or less, or 1.0 wt % or less, or 0.7 wt % or less, or 0.1 wt % or less, or 0.02 wt % or less (such as down to ~0 wt %). Conradson Carbon residue content can be determined according to ASTM D4530.

In various aspects, a feed can initially be exposed to a demetallization catalyst prior to exposing the feed to a hydrotreating catalyst. Deasphalted oils can have metals concentrations (Ni+V+Fe) on the order of 10-100 wppm. Exposing a conventional hydrotreating catalyst to a feed having a metals content of 10 wppm or more can lead to catalyst deactivation at a faster rate than may desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, the deasphalted oil can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas." is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 200 SCF/B (34 $Nm^3/m^3$) to about 2500 SCF/B (420 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10.000 scf/B (1781 $m^3/m^3$).

In various aspects, the deasphalted oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophosphates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt % about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

Hydroprocessed Effluent—Solvent Dewaxing to Form Group I Bright Stock

The hydroprocessed deasphalted oil (optionally including hydroprocessed vacuum gas oil) can be separated to form one or more fuel boiling range fractions (such as naphtha or distillate fuel boiling range fractions) and at least one lubricant base stock boiling range fraction. The lubricant base stock boiling range fraction(s) can then be solvent dewaxed to produce a lubricant base stock product with a reduced (or eliminated) tendency to form haze. Lubricant base stocks (including bright stock) formed by hydroprocessing a deasphalted oil and then solvent dewaxing the hydroprocessed effluent can tend to be Group I base stocks due to having an aromatics content of at least 10 wt % and/or a saturates content of less than 90 wt %.

Solvent dewaxing typically involves mixing a feed with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between about 1 to about 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil can be dewaxed to a pour point of −6° C. or less, or −10° C. or less, or −15° C. or less, depending on the nature of the target lubricant base stock product. Additionally or alternately, the solvent dewaxed oil can be dewaxed to a cloud point of −2° C. or less, or −5° C. or less, or −10° C. or less, depending on the nature of the target lubricant base stock product. The resulting solvent dewaxed oil can be suitable for use in forming one or more types of Group I base stocks. Preferably, a bright stock formed from the solvent dewaxed oil can have a cloud point below −5° C. The resulting solvent dewaxed oil can have a viscosity index of at least 90, or at least 95, or at least 100. Preferably, at least 10 wt % of the resulting solvent dewaxed oil (or at least 20 wt %, or at least 30 wt %) can correspond to a Group I bright stock having a kinematic viscosity at 100° C. of at least 15 cSt, or at least 20 cSt, or at least 25 cSt, such as up to 50 cSt or more.

In some aspects, the reduced or eliminated tendency to form haze for the lubricant base stocks formed from the solvent dewaxed oil can be demonstrated by a reduced or minimized difference between the cloud point temperature and pour point temperature for the lubricant base stocks. In various aspects, the difference between the cloud point and pour point for the resulting solvent dewaxed oil and/or for one or more lubricant base stocks, including one or more bright stocks, formed from the solvent dewaxed oil, can be 22° C. or less, or 20° C. or less, or 15° C. or less, or 10° C. or less, or 8° C. or less, or 5° C. or less. Additionally or alternately, a reduced or minimized tendency for a bright stock to form haze over time can correspond to a bright stock having a cloud point of −10° C. or less, or −8° C. or less, or −5° C. or less, or −2° C. or less.

Additional Hydroprocessing—Catalytic Dewaxing, Hydrofinishing, and Optional Hydrocracking In some alternative aspects, at least a lubricant boiling range portion of the hydroprocessed deasphalted oil can be exposed to further hydroprocessing (including catalytic dewaxing) to form either Group I and/or Group II base stocks, including Group I and/or Group II bright stock. In some aspects, a first lubricant boiling range portion of the hydroprocessed deasphalted oil can be solvent dewaxed as described above while a second lubricant boiling range portion can be exposed to further hydroprocessing. In other aspects, only solvent dewaxing or only further hydroprocessing can be used to treat a lubricant boiling range portion of the hydroprocessed deasphalted oil.

Optionally, the further hydroprocessing of the lubricant boiling range portion of the hydroprocessed deasphalted oil can also include exposure to hydrocracking conditions before and/or after the exposure to the catalytic dewaxing conditions. At this point in the process, the hydrocracking can be considered "sweet" hydrocracking, as the hydroprocessed deasphalted oil can have a sulfur content of 200 wppm or less.

Suitable hydrocracking conditions can include exposing the feed to a hydrocracking catalyst as previously described above. Optionally, it can be preferable to use a USY zeolite with a silica to alumina ratio of at least 30 and a unit cell size of less than 24.32 Angstroms as the zeolite for the hydrocracking catalyst, in order to improve the VI uplift from hydrocracking and/or to improve the ratio of distillate fuel yield to naphtha fuel yield in the fuels boiling range product.

Suitable hydrocracking conditions can also include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

For catalytic dewaxing, suitable dewaxing catalysts can include molecular sieves such as crystalline aluminosilicates (zeolites). In an embodiment, the molecular sieve can comprise, consist essentially of, or be ZSM-22, ZSM-23, ZSM-48. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various embodiments, the catalysts according to the invention further include a metal hydrogenation component. The metal hydrogenation component is typically a Group VI and/or a Group VIII metal. Preferably, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

Without being bound by any particular theory, it is believed that use of a low surface area binder reduces the amount of binder surface area available for the hydrogenation metals supported on the catalyst. This leads to an increase in the amount of hydrogenation metals that are supported within the pores of the molecular sieve in the catalyst.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 280° C. to 450° C., preferably 343° C. to 435° C., a hydrogen partial pressure of from 3.5 MPag to 34.6 MPag (500 psig to 5000 psig), preferably 4.8 MPag to 20.8 MPag, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Before and/or after catalytic dewaxing, the hydroprocessed deasphalted oil (i.e., at least a lubricant boiling range portion thereof) can optionally be exposed to an aromatic saturation catalyst, which can alternatively be referred to as a hydrofinishing catalyst. Exposure to the aromatic saturation catalyst can occur either before or after fractionation. If aromatic saturation occurs after fractionation, the aromatic saturation can be performed on one or more portions of the fractionated product. Alternatively, the entire effluent from the last hydrocracking or dewaxing process can be hydrofinished and/or undergo aromatic saturation.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. For supported hydrotreating catalysts, suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Solvent Processing of Catalytically Dewaxed Effluent or Input Flow to Catalytic Dewaxing For deasphalted oils derived from propane deasphalting, the further hydroprocessing (including catalytic dewaxing) can be sufficient to form lubricant base stocks with low haze formation and unexpected compositional properties. For deasphalted oils derived from $C_{4+}$ deasphalting, after the further hydroprocessing (including catalytic dewaxing), the resulting catalytically dewaxed effluent can be solvent processed to form one or more lubricant base stock products with a reduced or eliminated tendency to form haze. The type of solvent processing can be dependent on the nature of the initial hydroprocessing (hydrotreatment and/or hydrocracking) and the nature of the further hydroprocessing (including dewaxing).

In aspects where the initial hydroprocessing is less severe, corresponding to 10 wt % to 40 wt % conversion relative to ~700° F. (370° C.), the subsequent solvent processing can correspond to solvent dewaxing. The solvent dewaxing can be performed in a manner similar to the solvent dewaxing described above. However, this solvent dewaxing can be used to produce a Group II lubricant base stock. In some aspects, when the initial hydroprocessing corresponds to 10 wt % to 40 wt % conversion relative to 370° C., the catalytic dewaxing during further hydroprocessing can also be performed at lower severity, so that at least 6 wt % wax remains in the catalytically dewaxed effluent, or at least 8 wt %, or at least 10 wt %, or at least 12 wt %, or at least 15 wt %, such as up to 20 wt % The solvent dewaxing can then be used to reduce the wax content in the catalytically dewaxed effluent by 2 wt % to 10 wt %. This can produce a solvent dewaxed oil product having a wax content of 0.1 wt % to 12 wt %, or 0.1 wt % to 10 wt %, or 0.1 wt % to 8 wt %, or 0.1 wt % to 6 wt %, or 1 wt % to 12 wt %, or 1 wt % to 10 wt %, or 1 wt % to 8 wt %, or 4 wt % to 12 wt %, or 4 wt % to 10 wt %, or 4 wt % to 8 wt %, or 6 wt % to 12 wt %, or 6 wt % to 10 wt %. In particular, the solvent dewaxed oil can have a wax content of 0.1 wt % to 12 wt %, or 0.1 wt % to 6 wt %, or 1 wt % to 10 wt %, or 4 wt % to 12 wt %.

In various aspects, the subsequent solvent processing can correspond to solvent extraction. Solvent extraction can be used to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted oil, the raffinate phase can have an aromatics content of 5 wt % to 25 wt % and/or a saturates content of 75 wt % to 95 wt % (or more). For typical feeds, the aromatics contents can be at least 10 wt % and/or the saturates content can be 90 wt % or less. In various aspects, the raffinate yield from solvent extraction can be at least 40 wt %, or at least 50 wt %, or at least 60 wt %, or at least 70 wt %.

Optionally, the raffinate from the solvent extraction can be under-extracted. In such aspects, the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature.

The solvent processed oil (solvent dewaxed or solvent extracted) can have a pour point of −6° C. or less, or −10° C. or less, or −15° C. or less, or −20° C. or less, depending on the nature of the target lubricant base stock product. Additionally or alternately, the solvent processed oil (solvent dewaxed or solvent extracted) can have a cloud point of −2° C. or less, or −5° C. or less, or −10° C. or less, depending on the nature of the target lubricant base stock product. Pour points and cloud points can be determined according to ASTM D97 and ASTM D2500, respectively. The resulting solvent processed oil can be suitable for use in forming one or more types of Group II base stocks. The resulting solvent dewaxed oil can have a viscosity index of at least 80, or at least 90, or at least 95, or at least 100, or at least 110, or at least 120. Viscosity index can be determined according to ASTM D2270. Preferably, at least 10 wt % of the resulting solvent processed oil (or at least 20 wt %, or at least 30 wt %) can correspond to a Group II bright stock having a kinematic viscosity at 100° C. of at least 14 cSt, or at least 15 cSt, or at least 20 cSt, or at least 25 cSt, or at least 30 cSt, or at least 32 cSt, such as up to 50 cSt or more. Additionally or alternately, the Group II bright stock can have a kinematic viscosity at 40° C. of at least 300 cSt, or at least 320 cSt, or at least 340 cSt, or at least 350 cSt, such as up to 500 cSt or more. Kinematic viscosity can be determined according to ASTM D445. Additionally or alternately, the Conradson Carbon residue content can be about 0.1 wt % or less, or about 0.02 wt % or less. Conradson Carbon residue content can be determined according to ASTM D4530. Additionally or alternately, the resulting base stock can have a turbidity of at least 1.5 (in combination with a cloud point of less than 0° C.), or can have a turbidity of at least 2.0, and/or can have a turbidity of 4.0 or less, or 3.5 or less, or 3.0 or less. In particular, the turbidity can be 1.5 to 4.0, or 1.5 to 3.0, or 2.0 to 4.0, or 2.0 to 3.5.

The reduced or eliminated tendency to form haze for the lubricant base stocks formed from the solvent processed oil can be demonstrated by the reduced or minimized difference between the cloud point temperature and pour point temperature for the lubricant base stocks. In various aspects, the difference between the cloud point and pour point for the resulting solvent dewaxed oil and/or for one or more Group II lubricant base stocks, including one or more bright stocks, formed from the solvent processed oil, can be 22° C. or less, or 20° C. or less, or 15° C. or less, or 10° C. or less, such as down to about 1° C. of difference.

In some alternative aspects, the above solvent processing can be performed prior to catalytic dewaxing.

Group II Base Stock Products

For deasphalted oils derived from propane, butane, pentane, hexane and higher or mixtures thereof, the further hydroprocessing (including catalytic dewaxing) and potentially solvent processing can be sufficient to form lubricant base stocks with low haze formation (or no haze formation) and novel compositional properties. Traditional products manufactured today with kinematic viscosity of about 32 cSt at 100° C. contain aromatics that are >10% and/or sulfur that is >0.03% of the base oil.

In various aspects, base stocks produced according to methods described herein can have a kinematic viscosity of at least 14 cSt, or at least 20 cSt, or at least 25 cSt, or at least 30 cSt, or at least 32 cSt at 100° C. and can contain less than 10 wt % aromatics/greater than 90 wt % saturates and less than 0.03% sulfur. Optionally, the saturates content can be still higher, such as greater than 95 wt %, or greater than 97 wt %. In addition, detailed characterization of the branchiness (branching) of the molecules by C-NMR reveals a high degree of branch points as described further below in the examples. This can be quantified by examining the absolute number of methyl branches, or ethyl branches, or propyl branches individually or as combinations thereof. This can also be quantified by looking at the ratio of branch points (methyl, ethyl, or propyl) compared to the number of internal carbons, labeled as epsilon carbons by C-NMR This quantification of branching can be used to determine whether a base stock will be stable against haze formation over time. For $^{13}$C-NMR results reported herein, samples were prepared to be 25-30 wt % in $CDCl_3$ with 7% Chromium (III)-acetylacetonate added as a relaxation agent. $^{13}$C NMR experiments were performed on a JEOL ECS NMR spectrometer for which the proton resonance frequency is 400 MHz. Quantitative $^{13}$C NMR experiments were performed at 27° C. using an inverse gated decoupling experiment with a 45° flip angle, 6.6 seconds between pulses, 64 K data points and 2400 scans. All spectra were referenced to TMS at 0 ppm. Spectra were processed with 0.2-1 Hz of line broadening and baseline correction was applied prior to manual integration. The entire spectrum was integrated to determine the mole % of the different integrated areas as follows: 170-190 PPM (aromatic C); 30-29.5 PPM (epsilon carbons); 15-14.5 PPM (terminal and pendant propyl groups) 14.5-14 PPM—Methyl at the end of a long chain (alpha); 12-10 PPM (pendant and terminal ethyl groups). Total methyl content was obtained from proton NMR. The methyl signal at 0-1.1 PPM was integrated. The entire spectrum was integrated to determine the mole % of methyls. Average carbon numbers obtained from gas chromatography were used to convert mole % methyls to total methyls.

Also unexpected in the composition is the discovery using Fourier Transform Ion Cyclotron Resonance-Mass Spectrometry (FTICR-MS) and/or Field Desorption Mass Spectrometry (FDMS) that the prevalence of smaller naphthenic ring structures below 6 or below 7 or below 8 naphthene rings can be similar but the residual numbers of larger naphthenic rings structures with 7 or more rings or 8+ rings or 9+ rings or 10+ rings is diminished in base stocks that are stable against haze formation.

For FTICR-MS results reported herein, the results were generated according to the method described in U.S. Pat. No. 9,418,828. The method described in U.S. Pat. No. 9,418,828 generally involves using laser desorption with Ag ion complexation (LDI-Ag) to ionize petroleum saturates molecules (including 538° C.+ molecules) without fragmentation of the molecular ion structure. Ultra-high resolution Fourier Transform Ion Cyclotron Resonance Mass Spectrometry is applied to determine exact elemental formula of the saturates-Ag cations and corresponding abundances. The saturates fraction composition can be arranged by homologous series and molecular weights. The portion of U.S. Pat. No. 9,418,828 related to determining the content of saturate ring structures in a sample is incorporated herein by reference.

For FDMS results reported herein, Field desorption (FD) is a soft ionization method in which a high-potential electric field is applied to an emitter (a filament from which tiny "whiskers" have formed) that has been coated with a diluted sample resulting in the ionization of gaseous molecules of the analyte. Mass spectra produced by FD are dominated by molecular radical cations $M^+$ or in some cases protonated molecular ions $[M+H]^+$. Because FDMS cannot distinguish between molecules with 'n' naphthene rings and molecules with 'n+7' rings, the FDMS data was "corrected" by using the FTICR-MS data from the most similar sample. The FDMS correction was performed by applying the resolved ratio of "n" to "n+7" rings from the FTICR-MS to the unresolved FDMS data for that particular class of molecules. Hence, the FDMS data is shown as "corrected" in the figures.

Base oils of the compositions described above have further been found to provide the advantage of being haze free upon initial production and remaining haze free for extended periods of time. This is an advantage over the prior art of high saturates heavy base stocks that was unexpected.

Additionally, it has been found that these base stocks can be blended with additives to form formulated lubricants, such as but not limited to marine oils, engine oils, greases, paper machine oils, and gear oils. These additives may include, but are not restricted to, detergents, dispersants, antioxidants, viscosity modifiers, and pour point depressants. When so blended, the performance as measured by standard low temperature tests such as the Mini-Rotary Viscometer (MRV) and Brookfield test has been shown to be superior to formulations blended with traditional base oils.

It has also been found that the oxidation performance, when blended into industrial oils using common additives such as, but not restricted to, defoamants, pour point depressants, antioxidants, rust inhibitors, has exemplified superior oxidation performance in standard oxidation tests such as the US Steel Oxidation test compared to traditional base stocks.

Other performance parameters such as interfacial properties, deposit control, storage stability, and toxicity have also been examined and are similar to or better than traditional base oils.

In addition to being blended with additives, the base stocks described herein can also be blended with other base stocks to make a base oil. These other base stocks include solvent processed base stocks, hydroprocessed base stocks, synthetic base stocks, base stocks derived from Fisher-Tropsch processes, PAO, and naphthenic base stocks. Additionally or alternately, the other base stocks can include Group I base stocks, Group II base stocks, Group III base stocks, Group IV base stocks, and/or Group V base stocks. Additionally or alternately, still other types of base stocks for blending can include hydrocarbyl aromatics, alkylated aromatics, esters (including synthetic and/or renewable esters), and or other non-conventional or unconventional base stocks. These base oil blends of the inventive base stock and other base stocks can also be combined with additives, such as those mentioned above, to make formulated lubricants.

Other Additives

The formulated lubricating oil useful in the present disclosure may additionally contain one or more of the other commonly used lubricating oil performance additives including but not limited to antiwear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Other Additives—Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

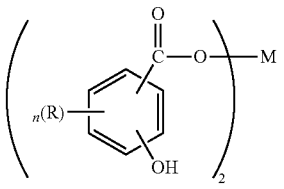

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

Another family of detergents is oil soluble ashless nonionic detergent. Typical nonionic detergents are polyoxyethylene, polyoxypropylene, polyoxybutylene alkyl ethers, or nonylphenol ethoxylates. For reference, see "Nonionic Surfactants: Physical Chemistry" Martin J. Schick, CRC Press; 2 edition (Mar. 27, 1987). These detergents are less common in engine lubricant formulations, but offer a number of advantages such as improved solubility in ester base stocks. The nonionic detergents that are soluble in hydrocarbons generally have a Hydrophilic-Lipophilic Balance (HLB) value of 10 or below.

To minimize the effect of ash deposit on engine knock and pre-ignition, including low speed pre-ignition, the most preferred detergents in this disclosure is an ashless nonionic detergent with a Hydrophilic-Lipophilic Balance (HLB) value of 10 or below. These detergents are commercially available from for example, Croda Inc., under the trade designations "Alarmol PS11E" and "Alarmol PS15E", from for example the Dow Chemical Co. the trade designation "Ecosurf EH-3", "Tergitol 15-S-3", "Tergitol L-61", "Tergitol L-62", "Tergitol NP-4", "Tergitol NP-6", "Tergitol NP-7", "Tergitol NP-8", "Tergitol NP-9", "Triton X-15", and "Triton X-35".

The detergent concentration in the lubricating oils of this disclosure can range from 0.5 to 6.0 weight percent, preferably 0.6 to 5.0 weight percent, and more preferably from 0.8 weight percent to 4.0 weight percent, based on the total weight of the lubricating oil.

Other Additives—Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful, although on occasion, having a hydrocarbon substituent between 20-50 carbon atoms can be useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2.500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000, or from 1000 to 3000, or 1000 to 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity index improvers. The lower molecular weight versions can be used as lubricant dispersants or fuel detergents.

The use of polymethacrylate or polyacrylate dispersants are preferred in polar esters of a non-aromatic dicarboxylic acid, preferably adipate esters, since many other conventional dispersants are less soluble. The preferred dispersants for polyol esters in this disclosure include polymethacrylate and polyacrylate dispersants.

Such dispersants may be used in an amount of 0.1 to 20 weight percent, preferably 0.5 to 8 weight percent, or more preferably 0.5 to 4 weight percent. The hydrocarbon numbers of the dispersant atoms can range from C60 to C1000, or from C70 to C300, or from C70 to C200. These dispersants may contain both neutral and basic nitrogen, and mixtures of both. Dispersants can be end-capped by borates and/or cyclic carbonates.

Still other potential dispersants can include polyalkenyls, such as polyalkenyls with a molecular weight of at least 900 and an average of 1.3 to 1.7 functional groups per polyalkenyl moiety. Yet other suitable polymers can include polymers formed by cationic polymerization of monomers such as isobutene and/or styrene.

Other Additives—Antiwear Agent

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

ZDDP is typically used in amounts of from 0.4 weight percent to 1.2 weight percent, preferably from 0.5 weight percent to 1.0 weight percent, and more preferably from 0.6 weight percent to 0.8 weight percent, based on the total weight of the lubricating oil, although more or less can often be used advantageously. Preferably, the ZDDP is a secondary ZDDP and present in an amount of from 0.6 to 1.0 weight percent of the total weight of the lubricating oil.

More generally, other types of suitable antiwear additives can include, for example, metal salts of a carboxylic acid. The metal can be a transition metal or a mixture of transition metals, such as one or more metals from Group 10, 11, or 12 of the IUPAC periodic table. The carboxylic acid can be an aliphatic carboxylic acid, a cycloaliphatic carboxylic acid, an aromatic carboxylic acid, or a mixture thereof.

Low phosphorus engine oil formulations are included in this disclosure. For such formulations, the phosphorus content is typically less than 0.12 weight percent preferably less than 0.10 weight percent, and most preferably less than 0.085 weight percent. Low phosphorus can be preferred in combination with the friction modifier.

Other Additives—Viscosity Index Improvers

Viscosity index improvers (also known as VI improvers, viscosity modifiers, and viscosity improvers) can be included in the lubricant compositions of this disclosure. Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,500,000, more typically about 20,000 to 1,200,000, and even more typically between about 50,000 and 1,000,000. The typical molecular weight for polymethacrylate or polyacrylate viscosity index improvers is less than about 50,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"), from Afton Chemical Corporation under the trade designation "HiTEC®" (such as "HiTEC®, 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The preferred viscosity index improvers in this disclosure when an ester of a non-aromatic dicarboxylic acid, preferably an alkyl adipate ester, is used as base stock, are polymethacrylate or polyacrylate polymers, including dispersant polymethacrylate and dispersant polyacrylate polymers. These polymers offer significant advantages in solubility in esters of a non-aromatic dicarboxylic acid, preferably alkyl adipate esters. The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

In an embodiment of this disclosure, the viscosity index improvers may be used in an amount of from 1.0 to about 20% weight percent, preferably 5 to about 15 weight percent, and more preferably 8.0 to about 12 weight percent, based on the total weight of the formulated oil or lubricating engine oil.

As used herein, the viscosity index improver concentrations are given on an "as delivered" basis. Typically, the active polymer is delivered with a diluent oil. The "as delivered" viscosity index improver typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Other Additives—Antioxidants

Antioxidants retard the oxidative degradation of base stocks during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is an aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

The preferred amine antioxidants in this disclosure include polymeric or oligomeric amines which are the polymerization reaction products of one or more substituted or hydrocarbyl-substituted diphenyl amines, one or more unsubstituted or hydrocarbyl-substituted phenyl naphthyl amines, or both one or more of unsubstituted or hydrocarbyl-substituted diphenylamine with one or more unsubstituted or hydrocarbyl-substituted phenyl naphthylamine.

Other more extensive oligomers are within the scope of this disclosure, but materials of formulae A, B, C and D are preferred Examples can be also found in U.S. Pat. No. 8,492,321.

Polymeric or oligomeric amines are commercially available from Nyco S.A. under the trade designation of Nycoperf AO337. The polymeric or oligomeric amine antioxidant is present in an amount in the range 0.5 to 10 wt % (active ingredient), preferably 2 to 5 wt % (active ingredient) of polymerized aminic antioxidant exclusive of any unpolymerized aryl amine which may be present or any added antioxidants. Sulfurized alkyl phenols and alkali or alkaline earth metal salts thereof also are useful antioxidants.

Preferred antioxidants also include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, more preferably zero to less than 1 weight percent.

Other Additives—Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Other Additives—Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Other Additives—Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers, usually the amount of these additives combined is less than 1 weight percent and often less than 0.1 weight percent.

Other Additives—Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Other Additives—Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base stocks, formulated lubricant compositions, or functional fluids, to modify the coefficient of friction of a lubricated surface may be effectively used in combination with the base stocks or lubricant compositions of the present disclosure if desired. Friction modifiers that lower the coefficient of friction are particularly advantageous in combination with the base stocks and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentacrythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred. Illustrative fatty alcohol ethers include, for example, stearyl ether, myristyl ether, and the like. Alcohols, including those that have carbon numbers from C3 to C5, can be ethoxylated, propoxylate, or butoxylated to form the corresponding fatty alkyl ethers. The underlying alcohol portion can preferably be stearyl, myristyl, C11-C13 hydrocarbon, oleyl, isosteryl, and the like.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 2000 ppm or more, and often with a preferred range of 50-1500 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below. It is noted that many of the additives are shipped from the additive manufacturer as a concentrate, containing one or more additives together, with a certain amount of base stock diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (pure polymer basis) | 0.0-8 | 0.1-6 |
| Anti-wear | 0.1-2 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Configuration Examples

FIG. 1 schematically shows a first configuration for processing of a deasphalted oil feed 110. Optionally, deasphalted oil feed 110 can include a vacuum gas oil boiling range portion. In FIG. 1, a deasphalted oil feed 110 is exposed to hydrotreating and/or hydrocracking catalyst in a first hydroprocessing stage 120. The hydroprocessed effluent from first hydroprocessing stage 120 can be separated into one or more fuels fractions 127 and a 370° C.+ fraction 125. The 370° C.+ fraction 125 can be solvent dewaxed 130 to form one or more lubricant base stock products, such as one or more light neutral or heavy neutral base stock products 132 and a bright stock product 134.

Figure 2:
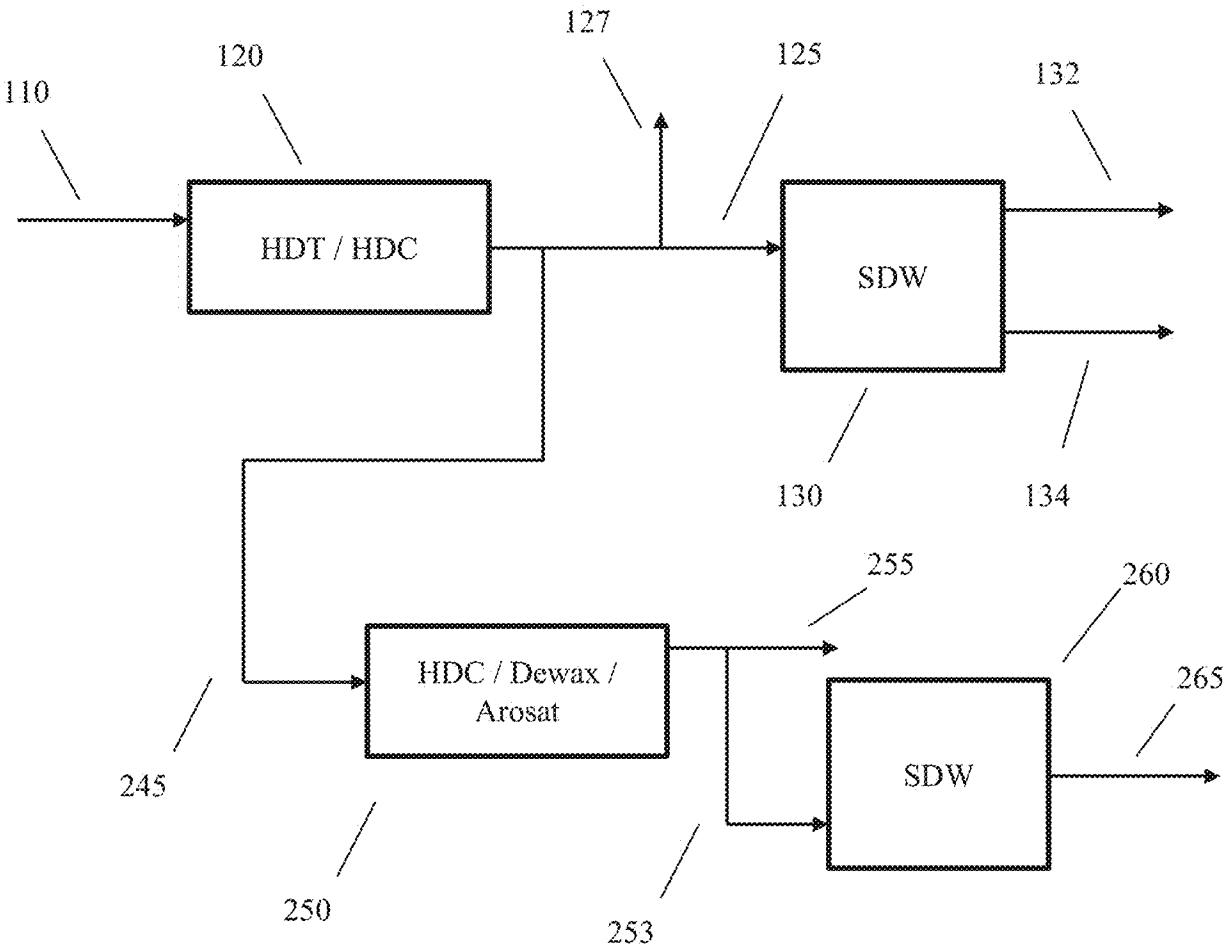
FIG. 2 schematically shows another example of a configuration for processing a deasphalted oil to form a lubricant base stock.

FIG. 2 schematically shows a second configuration for processing a deasphalted oil feed 110. In FIG. 2, solvent dewaxing stage 130 is optional. The effluent from first hydroprocessing stage 120 can be separated to form at least one or more fuels fractions 127, a first 370° C.+ portion 245, and a second optional 370° C.+ portion 225 that can be used as the input for optional solvent dewaxing stage 130. The first 370° C.+ portion 245 can be used as an input for a second hydroprocessing stage 250. The second hydroprocessing stage can correspond to a sweet hydroprocessing stage for performing catalytic dewaxing, aromatic saturation, and optionally further performing hydrocracking. In FIG. 2, at least a portion 253 of the catalytically dewaxed output 255 from second hydroprocessing stage 250 can be solvent dewaxed 260 to form at least a solvent processed lubricant boiling range product 265 that has a T10 boiling point of at least 510° C. and that corresponds to a Group II bright stock.

Figure 3:
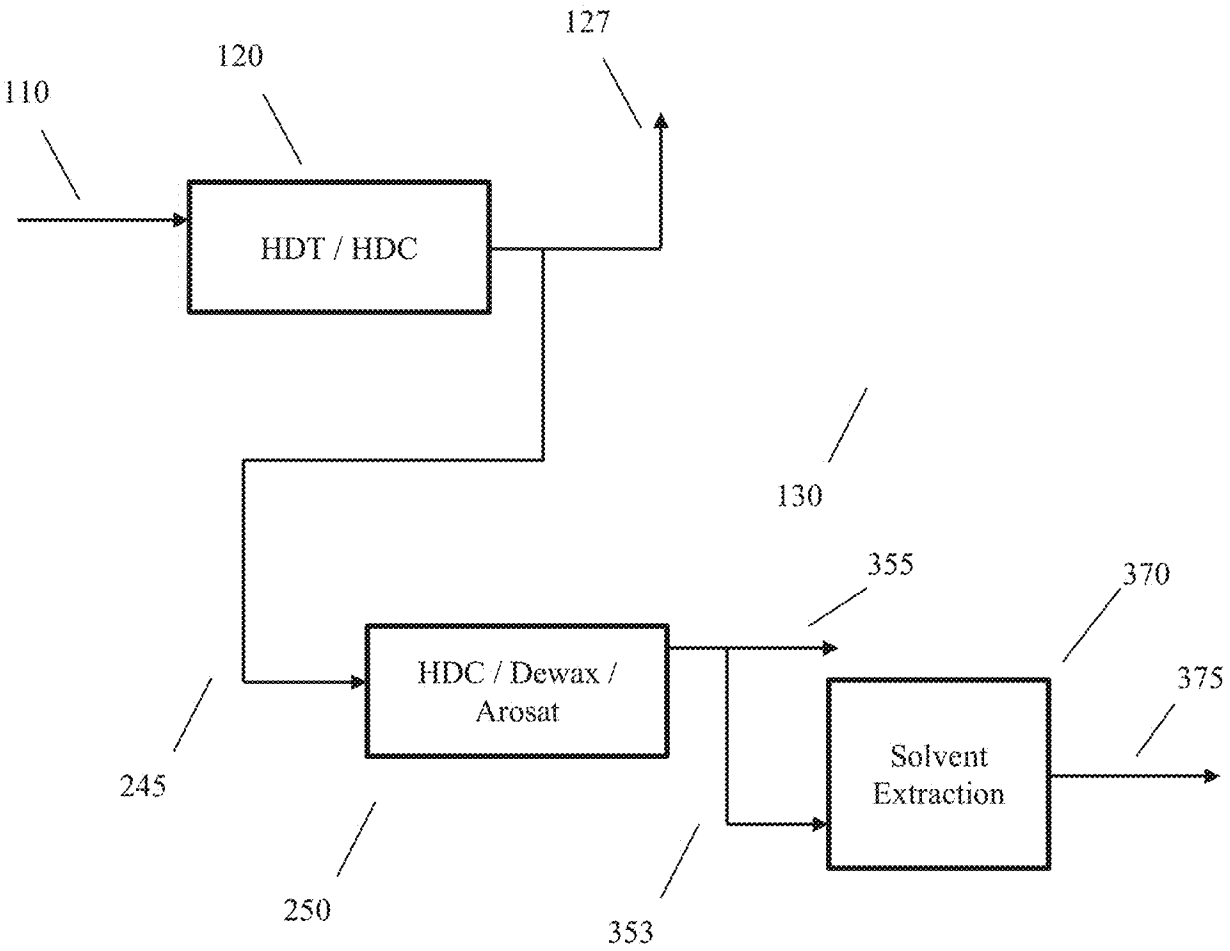
FIG. 3 schematically shows another example of a configuration for processing a deasphalted oil to form a lubricant base stock.

FIG. 3 schematically shows another configuration for producing a Group II bright stock. In FIG. 3, at least a portion 353 of the catalytically dewaxed output 355 from the second hydroprocessing stage 250 is solvent extracted 370 to form at least a processed lubricant boiling range product 375 that has a T10 boiling point of at least 510° C. and that corresponds to a Group II bright stock.

Figure 6:
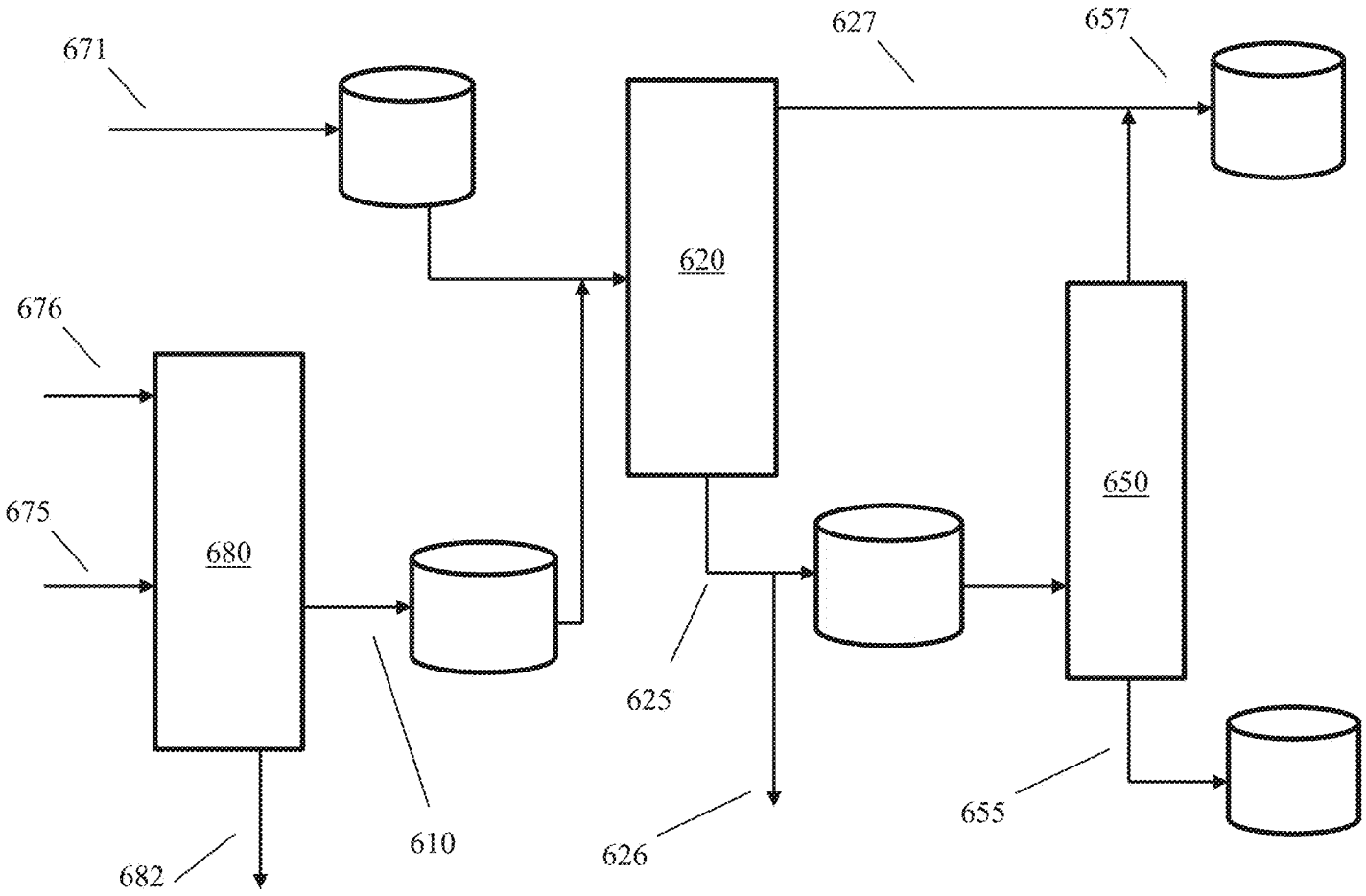
FIG. 6 schematically shows an example of a configuration for catalytic processing of deasphalted oil to form lubricant base stocks.

FIG. 6 schematically shows yet another configuration for producing a Group II bright stock. In FIG. 6, a vacuum resid feed 675 and a deasphalting solvent 676 is passed into a deasphalting unit 680. In some aspects, deasphalting unit 680 can perform propane deasphalting, but in other aspects a $C_{4+}$ solvent can be used. Deasphalting unit 680 can produce a rock or asphalt fraction 682 and a deasphalted oil 610. Optionally, deasphalted oil 610 can be combined with another vacuum gas oil boiling range feed 671 prior to being introduced into first (sour) hydroprocessing stage 620. A lower boiling portion 627 of the effluent from hydroprocessing stage 620 can be separated out for further use and/or processing as one or more naphtha fractions and/or distillate fractions. A higher boiling portion 625 of the hydroprocessing effluent can be a) passed into a second (sweet) hydroprocessing stage 650 and/or b) withdrawn 626 from the processing system for use as a fuel, such as a fuel oil or fuel oil blendstock. Second hydroprocessing stage 650 can produce an effluent that can be separated to form one or more fuels fractions 657 and one or more lubricant base stock fractions 655, such as one or more bright stock fractions.

Example 1

A configuration similar to FIG. 2 was used to process a deasphalted oil formed from butane deasphalting (55 wt % deasphalted oil yield). The properties of the deasphalted oil are shown in Table 2.

TABLE 2

Butane deasphalted oil (55 wt % yield)

| | |
|---|---|
| API Gravity | 14.0 |
| Sulfur (wt %) | 2.8 |
| Nitrogen (wppm) | 2653 |
| Ni (wppm) | 9.5 |
| V (wppm) | 14.0 |

TABLE 2-continued

| Butane deasphalted oil (55 wt % yield) | |
|---|---|
| CCR (wt %) | 8.3 |
| Wax (wt %) | 3.9 |
| GCD Distillation (wt %) | (° C.) |
| 5% | 480 |
| 10% | 505 |
| 30% | 558 |
| 50% | 597 |
| 70% | 641 |
| 90% | 712 |

The deasphalted oil in Table 2 was then processed at 0.2 $hr^{-1}$ LHSV, a treat gas rate of 8000 scf/b, a temperature of 371° C., and a pressure of 2250 psig over a catalyst fill of 50 vol % demetalization catalyst, 42.5 vol % hydrotreating catalyst, and 7.5% hydrocracking catalyst by volume. The demetallization catalyst was a commercially available large pore supported demetallization catalyst. The hydrotreating catalyst was a stacked bed of commercially available supported NiMo hydrotreating catalyst and commercially available bulk NiMo catalyst. The hydrocracking catalyst was a standard distillate selective catalyst used in industry. Such catalysts typically include NiMo or NiW on a zeolite/alumina support. Such catalysts typically have less than 40 wt % zeolite of a zeolite with a unit cell size of less than 34.38 Angstroms. A preferred zeolite content can be less than 25 wt % and/or a preferred unit cell size can be less than 24.32 Angstroms. Activity for such catalysts can be related to the unit cell size of the zeolite, so the activity of the catalyst can be adjusted by selecting the amount of zeolite. At least a portion of the hydroprocessed deasphalted oil was then exposed to further hydroprocessing without being solvent dewaxed.

The non-dewaxed hydrotreated product was processed over combinations of low unit cell size USY and ZSM-48. The resulting product had a high pour cloud spread differential resulting in a hazy product. However, a post-treat solvent dewaxing was able to remove that haze at a modest 3% loss in yield. Processing conditions for the second hydroprocessing stage included a hydrogen pressure of 1950 psig and a treat gas rate of 4000 scf/b. The feed into the second hydroprocessing stage was exposed to a) a 0.6 wt % Pt on USY hydrocracking catalyst (unit cell size less than 24.32, silica to alumina ratio of 35, 65 wt % zeolite/35 wt % binder) at 3.1 $hr^{-1}$ LHSV and a temperature of 665° F.; b) a 0.6 wt % Pt on ZSM-48 dewaxing catalyst (90:1 silica to alumina, 65 wt % zeolite/35 wt % binder) at 2.1 $hr^{-1}$ LHSV and a temperature of 635° F.; and c) 0.3 wt % Pt/0.9 wt % Pd on MCM-41 aromatic saturation catalyst (65 wt % zeolite/35 wt % binder) at 0.9 $hr^{-1}$ LHSV and a temperature of 480° F. The resulting properties of the 510° C.+ portion of the catalytically dewaxed effluent are shown in Table 3, along with the 510° C. conversion within the hydrocracking/catalytic dewaxing/aromatic saturation processes

TABLE 3

| Catalytically dewaxed effluent | |
|---|---|
| Product Fraction | |
| VI | 104.4 |
| KV @100° C. | 26.6 |
| KV @40° C. | 337 |
| Pour Pt (° C.) | −28 |

TABLE 3-continued

| Catalytically dewaxed effluent | |
|---|---|
| Product Fraction | |
| Cloud Pt (° C.) | 8.4 |
| Conversion (wt % relative to 510° C.) | 49 |

The product shown in Table 3 was hazy. However, an additional step of solvent dewaxing with a loss of only 2.5 wt % yield resulted in a bright and clear product with the properties shown in Table 4. It is noted that the pour point and the cloud point differ by slightly less than 20° C. The solvent dewaxing conditions included a slurry temperature of −30° C., a solvent corresponding to 35 wt % methyl ethyl ketone and 65 wt % toluene, and a solvent dilution ratio of 3:1.

TABLE 4

| Solvent Processed 510° C. + product (Group II bright stock) | |
|---|---|
| Product Fraction | |
| VI | 104.4 |
| KV @100° C. | 25.7 |
| KV @40° C. | 321 |
| Pour Pt (° C.) | −27 |
| Cloud Pt (° C.) | −7.1 |

Example 2

The deasphalted oil and vacuum gas oil mixture shown in Table 5 was processed in a configuration similar to FIG. 3.

TABLE 5

| Pentane deasphalted oil (65%) and vacuum gas oil (35%) properties | |
|---|---|
| API Gravity | 13.7 |
| Sulfur (wt %) | 3.6 |
| Nitrogen (wppm) | 2099 |
| Ni (wppm) | 5.2 |
| V (wppm) | 14.0 |
| CCR (wt %) | 8.1 |
| Wax (wt %) | 4.2 |
| GCD Distillation (wt %) | (°C) |
| 5% | 422 |
| 10% | 465 |
| 30% | 541 |
| 50% | 584 |
| 70% | n/a |
| 90% | 652 |

The conditions and catalysts in the first hydroprocessing stage were similar to Example 1, with the exception of adjustments in temperature to account for catalyst aging. The demetallization catalyst was operated at 744° F. (396° C.) and the HDT/HDC combination was operated at 761° F. (405° C.). This resulted in conversion relative to 510° C. of 73.9 wt % and conversion relative to 370° C. of 50 wt %. The hydroprocessed effluent was separated to remove fuels boiling range portions from a 370° C.+ portion. The resulting 370° C.+ portion was then further hydroprocessed. The further hydroprocessing included exposing the 370° C.+ portion to a 0.6 wt % Pt on ZSM-48 dewaxing catalyst (70:1 silica to alumina ratio, 65 wt % zeolite to 35 wt % binder)

followed by a 0.3 wt % Pt/0.9 wt % Pd on MCM-41 aromatic saturation catalyst (65% zeolite to 35 wt % binder). The operating conditions included a hydrogen pressure of 2400 psig, a treat gas rate of 5000 scf/b, a dewaxing temperature of 658° F. (348° C.), a dewaxing catalyst space velocity of 1.0 $hr^{-1}$, an aromatic saturation temperature of 460° F. (238° C.), and an aromatic saturation catalyst space velocity of 1.0 $hr^{-1}$. The properties of the 560° C.+ portion of the catalytically dewaxed effluent are shown in Table 6. Properties for a raffinate fraction and an extract fraction derived from the catalytically dewaxed effluent are also shown.

TABLE 6

| Catalytically dewaxed effluent | | | |
|---|---|---|---|
| Product Fraction | 560° C. + CDW effluent | Raffinate (yield 92.2%) | Extract |
| API | 30.0 | 30.2 | 27.6 |
| VI | 104.2 | 105.2 | 89 |
| KV @100° C. | 29.8 | 30.3 | 29.9 |
| KV @40° C. | 401 | 405 | 412 |
| Pour Pt (° C.) | −21 | −30 | |
| Cloud Pt (° C.) | 7.8 | −24 | |

Although the catalytically dewaxed effluent product was initially clear, haze developed within 2 days. Solvent dewaxing of the catalytically dewaxed effluent product in Table 9 did not reduce the cloud point significantly (cloud after solvent dewaxing of 6.5° C.) and removed only about 1 wt % of wax, due in part to the severity of the prior catalytic dewaxing. However, extracting the catalytically dewaxed product shown in Table 9 with n-methyl pyrrolidone (NMP) at a solvent/water ratio of 1 and at a temperature of 100° C. resulted in a clear and bright product with a cloud point of −24° C. that appeared to be stable against haze formation. The extraction also reduced the aromatics content of the catalytically dewaxed product from about 2 wt % aromatics to about 1 wt % aromatics. This included reducing the 3-ring aromatics content of the catalytically dewaxed effluent (initially about 0.2 wt %) by about 80%. This result indicates a potential relationship between waxy haze formation and the presence of polynuclear aromatics in a bright stock.

Example 3

A feed similar to Example 2 was processed in a configuration similar to FIG. 2, with various processing conditions modified. The initial hydroprocessing severity was reduced relative to the conditions in Example 2 so that the initial hydroprocessing conversion was 59 wt % relative to 510° C. and 34.5 wt % relative to 370° C. These lower conversions were achieved by operating the demetallization catalyst at 739° F. (393° C.) and the hydrotreating/hydrocracking catalyst combination at 756° F. (402° C.).

The hydroprocessed effluent was separated to separate fuels boiling range fraction(s) from the 370° C.+ portion of the hydroprocessed effluent. The 370° C.+ portion was then treated in a second hydroprocessing stage over the hydrocracking catalyst, and dewaxing catalyst described in Example 1. Additionally, a small amount of a hydrotreating catalyst (hydrotreating catalyst LHSV of 10 $hr^{-1}$) was included prior to the hydrocracking catalyst, and the feed was exposed to the hydrotreating catalyst under substantially the same conditions as the hydrocracking catalyst. The reaction conditions included a hydrogen pressure of 2400 psig and a treat gas rate of 5000 scf/b. In a first run, the second hydroprocessing conditions were selected to under dewax the hydroprocessed effluent. The under-dewaxing conditions corresponded to a hydrocracking temperature of 675° F. (357° C.), a hydrocracking catalyst LHSV of 1.2 $hr^{-1}$, a dewaxing temperature of 615° F. (324° C.), a dewaxing catalyst LHSV of 1.2 $hr^{-1}$, an aromatic saturation temperature of 460° F. (238° C.), and an aromatic saturation catalyst LHSV of 1.2 $hr^{-1}$. In a second run, the second hydroprocessing conditions were selected to more severely dewax the hydroprocessed effluent. The higher severity dewaxing conditions corresponded to a hydrocracking temperature of 675° F. (357° C.), a hydrocracking catalyst LHSV of 1.2 $hr^{-1}$, a dewaxing temperature of 645° F. (340° C.), a dewaxing catalyst LHSV of 1.2 $hr^{-1}$, an aromatic saturation temperature of 460° F. (238° C.), and an aromatic saturation catalyst LHSV of 1.2 $hr^{-1}$. The 510° C.+ portions of the catalytically dewaxed effluent are shown in Table 7.

TABLE 7

| Catalytically dewaxed effluents | | |
|---|---|---|
| Product Fraction | Under-dewaxed | Higher severity |
| VI | 106.6 | 106.4 |
| KV @100° C. | 37.6 | 30.5 |
| KV @40° C. | 551 | 396 |
| Pour Pt (° C.) | −24 | −24 |
| Cloud Pt (° C.) | 8.6 | 4.9 |

Both samples in Table 7 were initially bright and clear, but a haze developed in both samples within one week. Both samples were solvent dewaxed under the conditions described in Example 1. This reduced the wax content of the under-dewaxed sample to 6.8 wt % and the wax content of the higher severity dewaxing sample to 1.1 wt %. The higher severity dewaxing sample still showed a slight haze. However, the under-dewaxed sample, after solvent dewaxing, had a cloud point of −21° C. and appeared to be stable against haze formation.

Example 4—Viscosity and Viscosity Index Relationships

Figure 4:
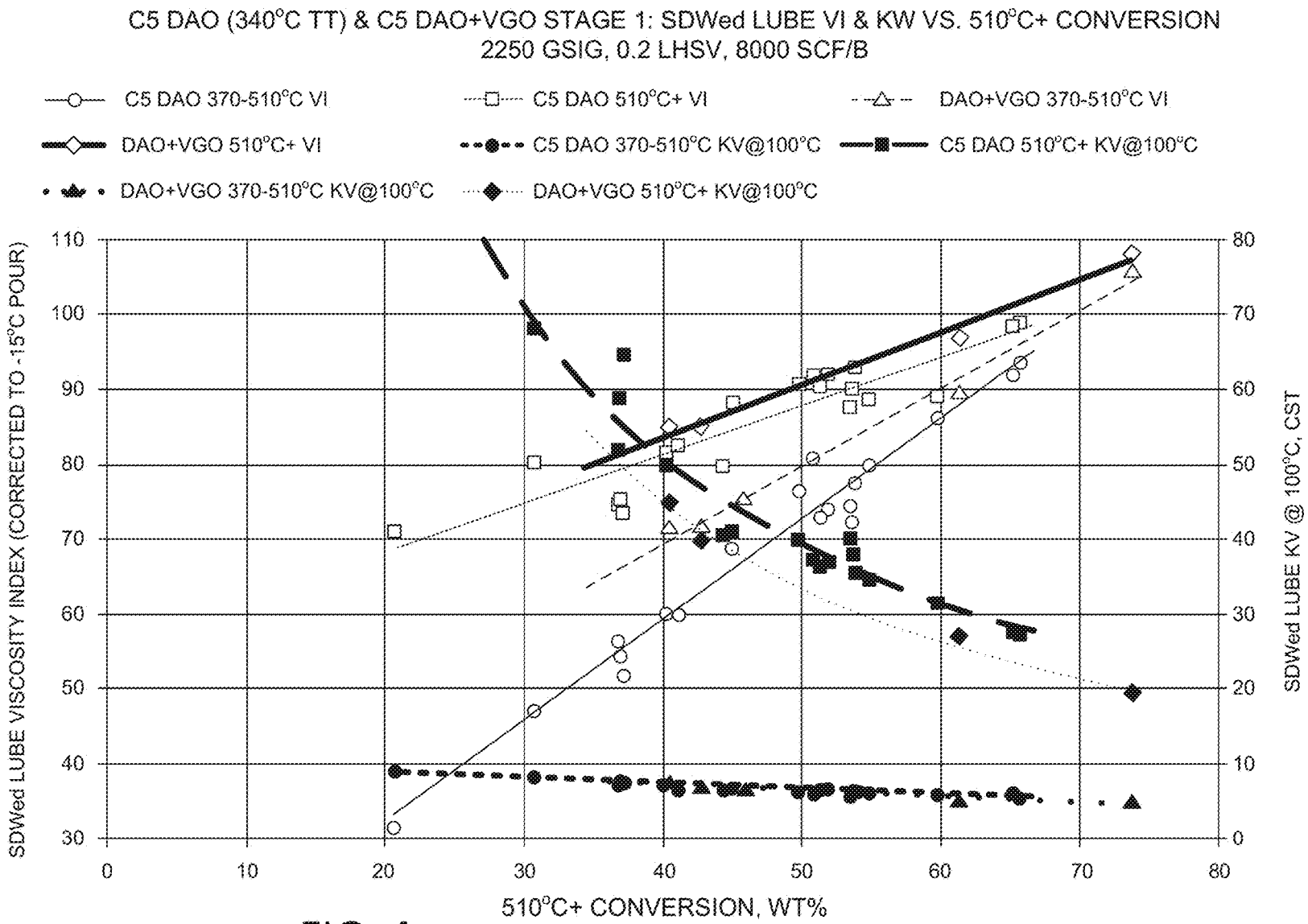
FIG. 4 shows results from processing a pentane deasphalted oil at various levels of hydroprocessing severity.

FIG. 4 shows an example of the relationship between processing severity, kinematic viscosity, and viscosity index for lubricant base stocks formed from a deasphalted oil. The data in FIG. 4 corresponds to lubricant base stocks formed form a pentane deasphalted oil at 75 wt % yield on resid feed. The deasphalted oil had a solvent dewaxed VI of 75.8 and a solvent dewaxed kinematic viscosity at 100° C. of 333.65.

In FIG. 4, kinematic viscosities (right axis) and viscosity indexes (left axis) are shown as a function of hydroprocessing severity (510° C.+ conversion) for a deasphalted oil processed in a configuration similar to FIG. 1, with the catalysts described in Example 1. As shown in FIG. 4, increasing the hydroprocessing severity can provide VI uplift so that deasphalted oil can be converted (after solvent dewaxing) to lubricant base stocks. However, increasing severity also reduces the kinematic viscosity of the 510° C.+ portion of the base stock, which can limit the yield of bright stock. The 370° C.-510° C. portion of the solvent dewaxed product can be suitable for forming light neutral and/or heavy neutral base stocks, while the 510° C.+ portion can be suitable for forming bright stocks and/or heavy neutral base stocks.

Example 5—Variations in Sweet and Sour Hydrocracking

In addition to providing a method for forming Group II base stocks from a challenged feed, the methods described herein can also be used to control the distribution of base stocks formed from a feed by varying the amount of conversion performed in sour conditions versus sweet conditions. This is illustrated by the results shown in FIG. 5.

Figure 5:
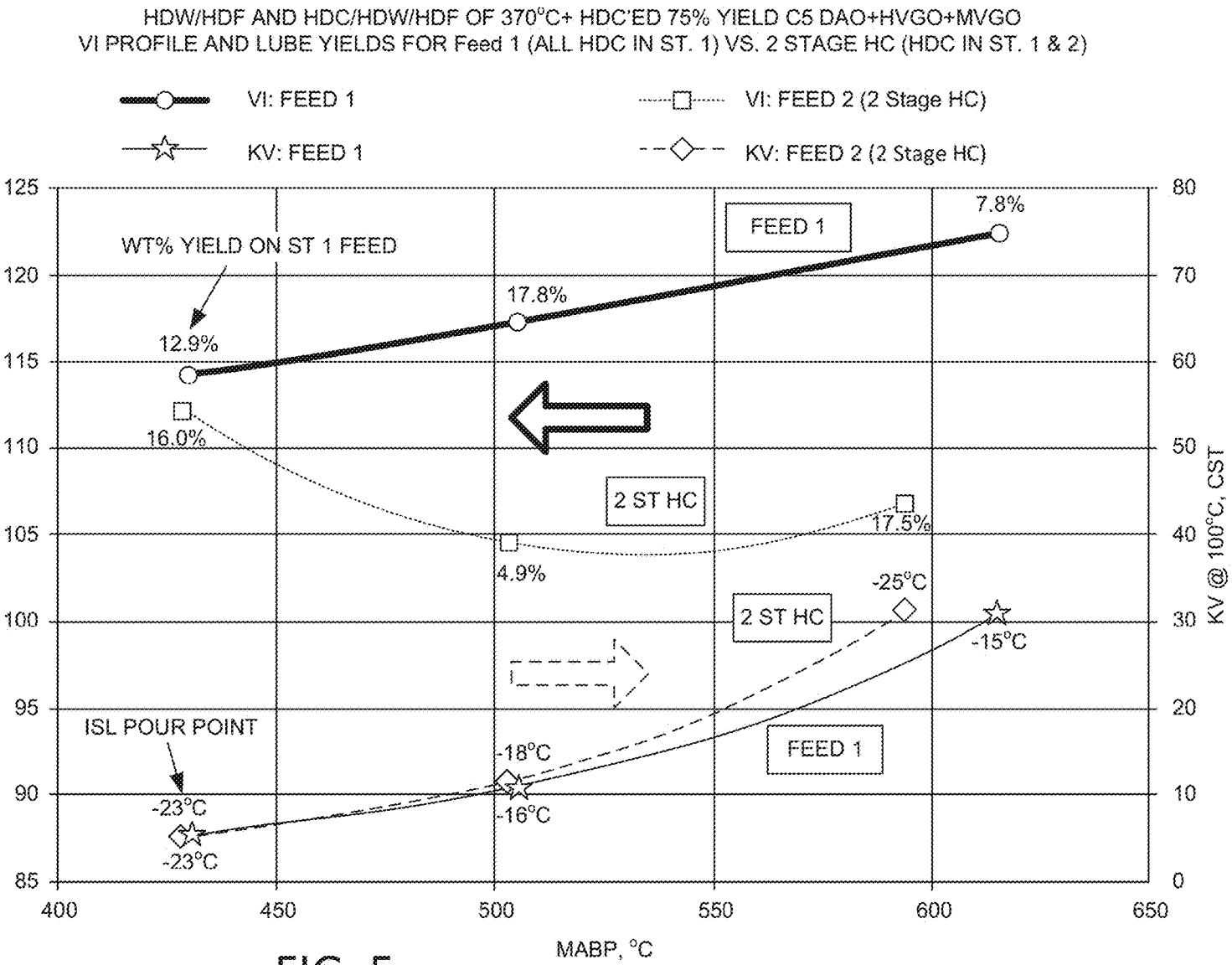
FIG. 5 shows results from processing deasphalted oil in configurations with various combinations of sour hydrocracking and sweet hydrocracking.

In FIG. 5, the upper two curves show the relationship between the cut point used for forming a lubricant base stock of a desired viscosity (bottom axis) and the viscosity index of the resulting base stock (left axis). The curve corresponding to the circle data points represents processing of a $C_5$ deasphalted oil using a configuration similar to FIG. 2, with all of the hydrocracking occurring in the sour stage. The curve corresponding to the square data points corresponds to performing roughly half of the hydrocracking conversion in the sour stage and the remaining hydrocracking conversion in the sweet stage (along with the catalytic dewaxing). The individual data points in each of the upper curves represent the yield of each of the different base stocks relative to the amount of feed introduced into the sour processing stage. It is noted that summing the data points within each curve shows the same total yield of base stock, which reflects the fact that the same total amount of hydrocracking conversion was performed in both types of processing runs. Only the location of the hydrocracking conversion (all sour, or split between sour and sweet) was varied.

The lower pair of curves provides additional information about the same pair of process runs. As for the upper pair of curves, the circle data points in the lower pair of curves represent all hydrocracking in the sour stage and the square data points correspond to a split of hydrocracking between sour and sweet stages. The lower pair of curves shows the relationship between cut point (bottom axis) and the resulting kinematic viscosity at 100° C. (right axis). As shown by the lower pair of curves, the three cut point represent formation of a light neutral base stock (5 or 6 cSt), a heavy neutral base stock (10-12 cSt), and a bright stock (about 30 cSt). The individual data points for the lower curves also indicate the pour point of the resulting base stock.

As shown in FIG. 5, altering the conditions under which hydrocracking is performed can alter the nature of the resulting lubricant base stocks. Performing all of the hydrocracking conversion during the first (sour) hydroprocessing stage can result in higher viscosity index values for the heavy neutral base stock and bright stock products, while also producing an increased yield of heavy neutral base stock. Performing a portion of the hydrocracking under sweet conditions increased the yield of light neutral base stock and bright stock with a reduction in heavy neutral base stock yield. Performing a portion of the hydrocracking under sweet conditions also reduced the viscosity index values for the heavy neutral base stock and bright stock products. This demonstrates that the yield of base stocks and/or the resulting quality of base stocks can be altered by varying the amount of conversion performed under sour conditions versus sweet conditions.

Example 6—Feedstocks and DAOs

Table 8 shows properties of two types of vacuum resid feeds that are potentially suitable for deasphalting, referred to in this example as Resid A and Resid B. Both feeds have an API gravity of less than 6, a specific gravity of at least 1.0, elevated contents of sulfur, nitrogen, and metals, and elevated contents of carbon residue and n-heptane insolubles.

TABLE 8

Resid Feed Properties

| Resid (566° C.+) | Resid A | Resid B |
|---|---|---|
| API Gravity (degrees) | 5.4 | 4.4 |
| Specific Gravity (15° C.) (g/cc) | 1.0336 | 1.0412 |
| Total Sulfur (wt %) | 4.56 | 5.03 |
| Nickel (wppm) | 43.7 | 48.7 |
| Vanadium (wppm) | 114 | 119 |
| TAN (mg KOH/g) | 0.314 | 0.174 |
| Total Nitrogen (wppm) | 4760 | 4370 |
| Basic Nitrogen (wppm) | 1210 | 1370 |
| Carbon Residue (wt %) | 24.4 | 25.8 |
| n-heptane insolubles (wt %) | 7.68 | 8.83 |
| Wax (Total - DSC) (wt %) | 1.4 | 1.32 |
| KV @ 100° C. (cSt) | 5920 | 11200 |
| KV @ 135° C.(cSt) | 619 | 988 |

The resids shown in Table 8 were used to form deasphalted oil. Resid A was exposed to propane deasphalting (deasphalted oil yield <40%) and pentane deasphalting conditions (deasphalted oil yield ~65%). Resid B was exposed to butane deasphalting conditions (deasphalted oil yield ~75%). Table 9 shows properties of the resulting deasphalted oils.

TABLE 9

Examples of Deasphalted Oils

| | $C_3$ DAO | $C_4$ DAO | $C_5$ DAO |
|---|---|---|---|
| API Gravity (degrees) | 22.4 | 12.9 | 12.6 |
| Specific Gravity (15° C.) (g/cc) | 0.9138 | 0.9782 | 0.9808 |
| Total Sulfur (wt %) | 2.01 | 3.82 | 3.56 |
| Nickel (wppm) | <0.1 | 5.2 | 5.3 |
| Vanadium (wppm) | <0.1 | 15.6 | 17.4 |
| Total Nitrogen (wppm) | 504 | 2116 | 1933 |
| Basic Nitrogen (wppm) | 203 | <N/A> | 478 |
| Carbon Residue (wt %) | 1.6 | 8.3 | 11.0 |
| KV @ 100° C. (cSt) | 33.3 | 124 | 172 |
| VI | 96 | 61 | <N/A> |
| SimDist (ASTM D2887) ° C. | | | |
| 5 wt % | 509 | 490 | 527 |
| 10 wt % | 528 | 515 | 546 |
| 30 wt % | 566 | 568 | 588 |
| 50 wt % | 593 | 608 | 619 |
| 70 wt % | 623 | 657 | 664 |
| 90 wt % | 675 | <N/A> | <N/A> |
| 95 wt % | 701 | <N/A> | <N/A> |

As shown in Table 9, the higher severity deasphalting provided by propane deasphalting results in a different quality of deasphalted oil than the lower severity $C_4$ and $C_5$ deasphalting that was used in this example. It is noted that the $C_3$ DAO has a kinematic viscosity @100° C. of less than 35, while the $C_4$ DAO and $C_5$ DAO have kinematic viscosities greater than 100. The $C_3$ DAO also generally has properties more similar to a lubricant base stock product, such as a higher API gravity, a lower metals content/sulfur content/nitrogen content, lower CCR levels, and/or a higher viscosity index.

Example 7—Lubricant Base Stocks from Catalytic Processing of $C_3$ and $C_4$ Deasphalted Oil A configuration similar to FIG. 6 was used to form lubricant base stocks from deasphalted oil formed by propane deasphalting. FIG. 7 shows compositional details for examples of bright stocks that were produced from catalytic processing of $C_3$ deasphalted oils (Samples I and II in FIG.

7). FIG. 7 also shows two reference bright stocks formed by either solvent dewaxing or catalytic dewaxing (Ref 1 and Ref 2), and an additional bright stock formed from a $C_3$ deasphalted oil (Sample III), but with a high cloud point of 6° C.

For the bright stocks shown as Samples I and II in FIG. 7, the bright stocks were formed by hydrotreatment (sour conditions) followed by catalytic dewaxing (sweet conditions) of the $C_3$ deasphalted oil. Samples I and II in FIG. 7 correspond to a bright stocks with less than 0.03 wt % sulfur and less than 10 wt % aromatics/greater than 90 wt % saturates. Thus, Samples I and II correspond to Group II bright stocks. The reference bright stocks in the first two columns of FIG. 7, as well as Sample III, also have less than 10 wt % aromatics/greater than 90 wt % saturates and therefore also correspond to Group II bright stocks.

The compositional characterization was done using $^{13}$C-NMR, FDMS (Field Desorption Mass Spectrometry), FTICR-MS (Fourier-Transform Ion Cyclotron Resonance Mass Spectrometry), and DSC (Differential Scanning Calorimetry). The differences in composition include the inventive base stocks having a higher degree of branching than a conventional bright stock. For example, the sum of the propyl and ethyl groups (Line 9) is greater than 1.7, or 1.8, or 1.9 per 100 carbon atoms in Samples I and II. Additionally, in Samples I and II, the types of individual branching are higher than their references. Samples I and II show a total number of terminal/pendant propyl groups greater than 0.85, or greater than 0.86, or greater than 0.90 per 100 carbon atoms; they show a total number of ethyl groups greater than 0.85, or greater than 0.88, or greater than 0.90, or greater than 0.93, or greater than 0.95 per 100 carbon atoms. Additionally, although not shown in FIG. 7, Samples I and II have a total number alpha carbon atoms greater than 2.1, or greater than 2.2, or greater than 2.22, or greater than 2.3 per 100 carbon atoms.

Further, the inventive base stocks exhibited more external branching within paraffinic chains. For Samples I and II, the total number of propyl and ethyl groups relative to epsilon carbon atoms was greater than 0.127, or greater than 0.130, or greater than 0.133, or greater than 0.140, or greater than 0.150 or greater than 0.160. Similarly, the ratio of propyl groups to epsilon carbon atoms was greater than 0.063 or greater than 0.065, and the ratio of ethyl groups to epsilon carbon atoms was greater than 0.064, or greater than 0.065, or greater than 0.068, or greater than 0.070, respectively. Additionally, although not shown in FIG. 7, the ratio of alpha carbons to the sum of propyl and ethyl groups is smaller in Samples I and II; less than 1.36, or less than 1.3, or less than 1.25, or less than 1.24.

Still other differences in the composition of Samples I and II over the references can be seen in the distribution of cycloparaffinic species as determined by FDMS. For example, the inventive bright stocks have at least 20% (i.e., at least 20 molecules per 100 molecules of the composition) of 2-ring cycloparaffins; at least 22% (i.e., at least 22 molecules per 100 molecules of the composition) of 3-ring cycloparaffins; less than 13.5% (i.e., less than 13.5 molecules per 100 molecules of the composition) of 5-ring cycloparaffins; and less than 8.5%/o (i.e., less than 8.5 molecules per 100 molecules of the composition), or less than 8.0 molecules per 100 molecules, or less than 7.0 molecules per 100 molecules, of 6-ring cycloparaffins. Comparing the ratio of 1, 2, and 3 ring cycloparaffins to 4, 5, and 6 ring cycloparaffins, differences are observed in that the ratio in Samples I and II is at least 1.1. Additionally, the ratio of 5 and 6 ring cycloparaffins to 2 and 3 ring cycloparaffins is less than 0.58, or less than 0.57.

Also, the inventive oils were also characterized using differential scanning calorimetry (DSC) to determine the total amount of residual wax and the distribution of residual wax as a function of temperature. The DSC cooling and heating curves were obtained for the base stocks described herein. Notably, the heating curve was generated by starting from a low temperature of nearly −80° C., at which point the sample is completely solidified, and then heating the sample at rate of about 10° C./min. As the temperature increases, typically, the heat flow rapidly decreases and reaches a minimum at around −20° C. to −10° C. Between −20° C. and abound +10° C., the rate of heat flow increases as the microcrystalline wax melts. The typical rate of increase found in the references ranged from 0.00068 to 0.013 W/g-° C. whereas column 4 had a less rapid change in heat flow at a rate of 0.00042 W/g-° C., indicative of a novel composition and distribution of waxy species.

It was determined that the novel product composition space shown in FIG. 7 could be achieved using catalytic processing of $C_3$ deasphalted oil having a VI of about 96, a CCR of about 1.6 wt %, and with nitrogen of about 504 ppmw. It has further been found that a similar novel product composition space can be achieved with more challenging feedstocks such as base stocks produced from $C_4$ deasphalted oil or from $C_5$ deasphalted oil or from $C_{6+}$ deasphalted oil or from mixtures thereof. This is illustrated in FIG. 8, where base stock compositions are shown that derived from $C_4$ deasphalted oil (55-65% deasphalted oil yield). The base stocks shown were produced using catalytic processing with and without solvent post-processing steps. There is an increased risk of the appearance of haze in the final product if the stock does not occupy the compositional space described below. Samples IV and V in FIG. 8 correspond to base stocks that remained clear and bright, while Samples VI, VII, and VIII correspond to base stocks that developed a haze, as would be conventionally expected when attempting to form base stocks from a $C_{4+}$ DAO. Ref 1 and Ref 2 in FIG. 8 are the same as the references in FIG. 7.

The compositional characterization was done using 13C-NMR, FDMS, FTICR-MS, and DSC. The differences in composition include the inventive base stocks having a higher degree of branching than a conventional bright stock. For example, the sum of the terminal/pendant propyl and ethyl groups is greater than 1.7, or 1.75, or 1.8, or 1.85, or 1.9 per 100 carbon atoms in Samples IV and V. Additionally, in Samples IV and V, the types of individual branching are higher than the references. Specifically, Samples IV and V show a total number of terminal/pendant propyl groups greater than 0.86, or greater than 0.88 per 100 carbon atoms; they also show a total number of terminal/pendant ethyl groups greater than 0.88, or greater than 0.90, or greater than 0.93, or greater than 0.95 per 100 carbon atoms. Although not shown in FIG. 8, Samples IV and V also had a total number alpha carbon atoms of 2.3 or greater per 100 carbon atoms.

Further, the inventive base stocks exhibited more external branching within paraffinic chains. For Samples IV and V, the total number of propyl and ethyl groups relative to epsilon carbon atoms was greater than 0.124, or greater than 0.127, or greater than 0.130, or greater than 0.133. Similarly, the ratio of propyl groups to epsilon carbon atoms and the ratio of ethyl groups to epsilon carbon atoms was greater than 0.060 or greater than 0.063 or greater than 0.064 or greater than 0.065, and 0.064 or greater than 0.065, or greater than 0.068, respectively.

FDMS provides more information concerning the ring structures in the inventive bright stocks. Samples IV and V show increased prevalence of 1, 2 and 3 ring cycloparaffins and decreased prevalence of 4, 5 and 6 ring cycloparaffins. For example, Samples IV and V have at least 10.7% (i.e., at least 10.7 molecules per 100 molecules of the composition), or at least 11%, or at least 11.5%, or at least 11.9% 1 ring cycloparaffins; and at least 19.8%, or at least 20% (i.e., at least 20.0 molecules per 100 molecules of the composition), or at least 20.5%, or at least 20.8% 2 ring cycloparaffins; at least 21.8%, or at least 21.9%, or at least 22% (i.e., at least 22.0 molecules per 100 molecules of the composition) 3 ring cycloparaffins; less than 17.6% (i.e., less than 17.6 molecules per 100 molecules of the composition), or less than 17.5%, or less than 17.1%, or less than 17% 4 ring cycloparaffins; less than 11.9% (i.e., less than 11.9 molecules per 100 molecules of the composition), or less than 11.5%, or less than 11%, or less than 10.9% 5 ring cycloparaffins; and less than 7.2%, or less than 7% (i.e., less than 7.0 molecules per 100 molecules of the composition), or less than 6.5%, or less than 6.3% 6 ring cycloparaffins. Comparing the ratio of 1, 2, and 3 ring cycloparaffins to 4, 5, and 6 ring cycloparaffins, differences are observed in that the ratio in Samples IV and V is at least 1.41, or at least 1.45, or at least 1.5, or at least 1.55, or at least 1.59 (line 68). Samples IV and V also show a ratio of 5 and 6 ring cycloparaffins to 2 and 3 ring cycloparaffins of 0.40 or less.

Example 8—Formulated Lubricant Properties

Several of the clear and bright Group II bright stocks described in Example 11 (formed from the $C_3$ and $C_4$ deasphalted oils) were used to make formulated engine oils and gear oils. The two reference Group I bright stocks shown in Example 11 were also formulated in a similar manner to allow for a comparison of properties.

Figure 9:
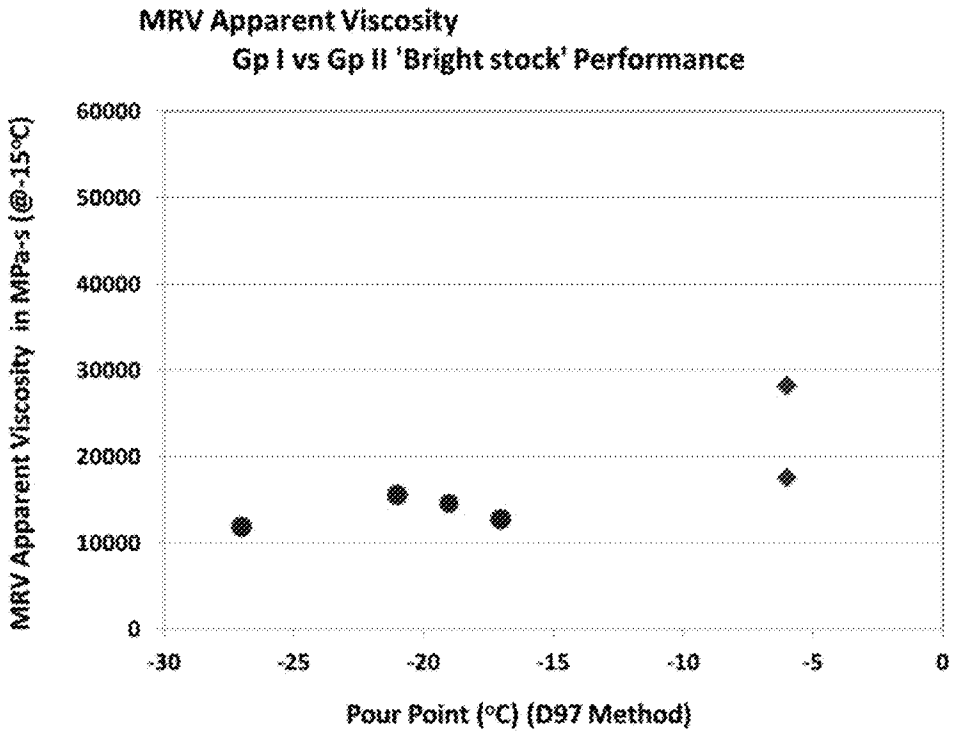
FIG. 9 shows properties of formulated lubricants formed using Group I and Group II bright stocks.

FIG. 9 shows results from MRV testing of a 25W-50 engine oil formed from a) the various Group II bright stocks made according to methods described herein and b) the reference Group I brightsocks. The circles correspond to the Group II bright stocks, while the diamonds correspond to the reference Group I bright stocks. FIG. 9 shows that the Group II bright stocks from Example 11 provided a substantially lower pour point for the resulting 25W-50 engine oil. The Group II bright stocks also provided a lower apparent MRV viscosity.

Figure 10:
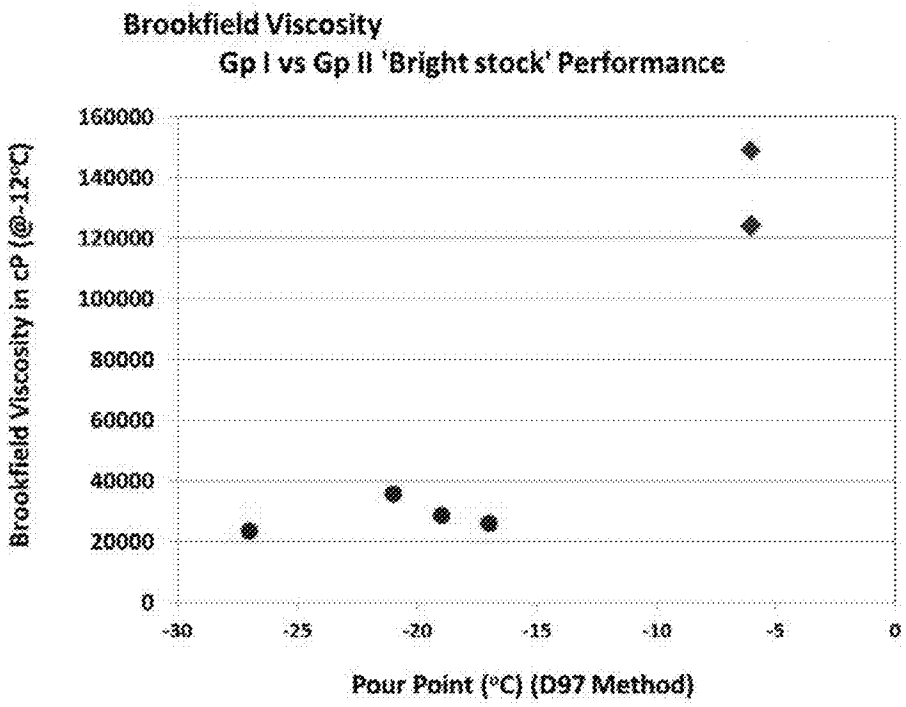
FIG. 10 shows properties of formulated lubricants formed using Group I and Group II bright stocks.

FIG. 10 shows results from Brookfield Viscosity testing of a 85W-140 gear oil when made from the Group II bright stocks and the reference Group I bright stocks. FIG. 10 shows that the Group II bright stocks once again provided an improved combination of lower pour point and lower Brookfield viscosity.

Figure 11:
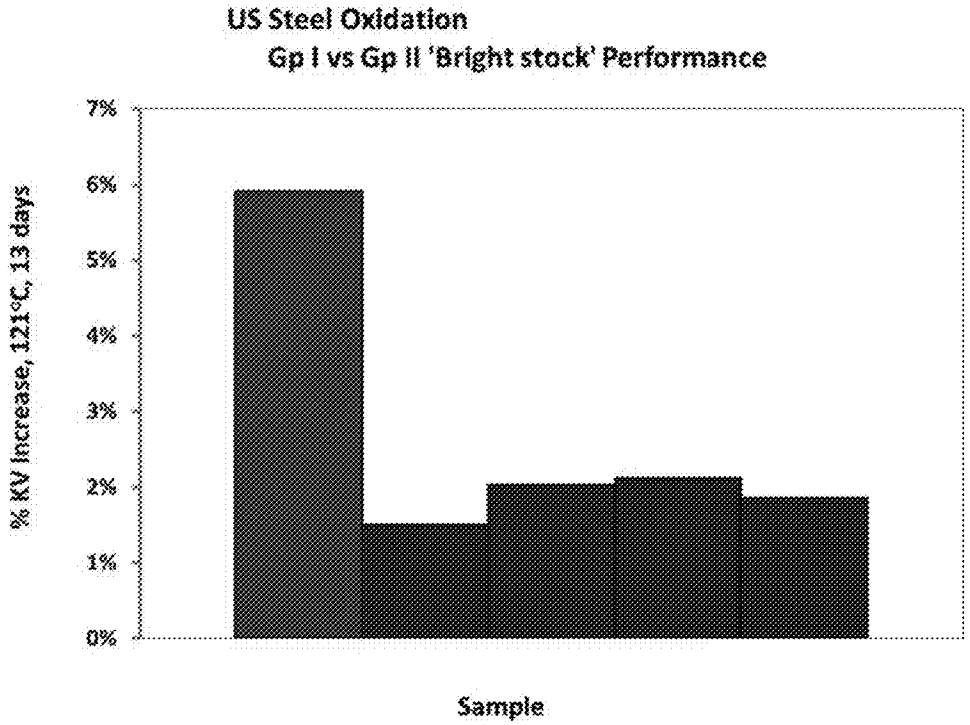
FIG. 11 shows properties of formulated lubricants formed using Group I and Group II bright stocks.

FIG. 11 shows results from US Steel Oxidation testing of a gear oil formed from a reference Group I bright stock (left bar) and the various Group II bright stocks (right 4 bars). FIG. 11 shows that the gear oils formulated with the Group II bright stocks had a substantially smaller percentage increase in kinematic viscosity over the course of the oxidation test.

Example 9—Lubricant Base Stocks from Catalytic Processing of $C_5$ Deasphalted Oil FIGS. 12 and 13 provide details from characterization of various base stock compositions that were formed from $C_5$ deasphalted oils. FIG. 12 shows properties determined using various techniques, including $^{13}$C-NMR, while FIG. 13 shows properties determined using FTICR-MS and FDMS. Ref 1 is the same as Ref 1 from FIGS. 7 and 8. Samples A, B, and C correspond to novel compositions, while Samples D, E, F, and G correspond to additional comparative base stocks made from $C_5$ deasphalted oil.

The compositional characterization was done using 13C-NMR, FDMS, FTICR-MS, and DSC. The differences in composition include the inventive base stocks having a higher degree of branching than a conventional bright stock as observed using NMR. For example, as shown FIG. 12, the comparative and reference bright stocks have a sum of terminal/pendant propyl and terminal/pendant ethyl groups of 1.67 (or less) per 100 carbon atoms in the composition. By contrast, in line 11 of FIG. 16, the inventive bright stocks have a value of at least 1.7, or at least 1.8, or at least 1.9, or at least 2, or at least 2.2 per 100 carbons. Similarly, individual values for terminal/pendant propyl and ethyl groups for the reference/comparative bright stocks are 0.84 or less and 1.04 or less (respectively) per 100 carbons. The inventive bright stocks (Samples A, B, and C) have values of at least 0.85, or at least 0.9 or at least 1.0 per 100 carbons for propyl groups and at least 0.85, or at least 1.0, or at least 1.1, or at least 1.15, or at least 1.2 per 100 carbons for ethyl groups. Further, although not shown in FIG. 12, the branch points of Samples A, B, and C are characterized by have a total branch points of at least 4.1 per 100 carbon atoms and of those branch points, less than 2.8 per 100 carbons are alpha carbons.

Samples A, B, and C showed more external branching within paraffinic chains as seen when comparing the ratios of various branch points to epsilon carbons. Comparing the ratio of the sum of propyl and ethyl groups to the epsilon carbons indicates a higher degree of branching in the inventive bright stocks. The reference/comparative bright stocks have a ratio of less than 0.13 for the sum of ethyl and propyl groups relative to the number of epsilon carbons, while the inventive bright stocks have at least 0.1, or at least 0.13, or at least 0.14, or at least 0.15, or at least 0.16 or at least 0.19 for the sum of ethyl and propyl groups to epsilon carbons. Individually comparing propyl or ethyl groups to epsilon carbons shows a similar relationship with reference bright stocks having less than 0.058 and 0.059 respectively. Samples A, B, and C have values of at least 0.06, or at least 0.07, or at least 0.08 or at least 0.09 for propyl/epsilon and at least 0.06, or at least 0.07, or at least 0.08, or at least 0.1 for ethyl/epsilon. Additionally, the total number of epsilon carbons is lower in the inventive bright stocks: greater than 14.5 for the reference/comparative bright stocks and less than 14.5, or less than 13, or less than 12.5, or less than 12.35 or less than 11 for the inventive bright stocks.

Although not shown in FIG. 12, the proportion of the type of branch points is also unique in the inventive bright stocks. The reference base stocks have a ratio of alpha carbons to ethyl groups of at least 2.8 and a ratio of alpha carbons to the sum of ethyl and propyl groups of at least 1.8. The inventive bright stocks have a ratio of alpha carbons to ethyl groups of less than 2.6, or less than 2.54, or less than 2.5, or less than 2.2 or less than 2 and a ratio of alpha carbons to the sum of ethyl and propyl groups of less than 2, or less than 1.4, or less than 1.38, or less than 1.3, or less than 1.1, or less than 1 or less than 0.9. Similarly the proportion of propyl and ethyl groups to total branch points is less than 0.41 for the reference/comparative bright stocks and at least 0.39, or at least 0.4, or at least 0.42, or at least 0.43, or at least 0.45, or at least 0.46 or at least 0.48 for the inventive bright stocks with the alpha carbons making up the remainder of branch points at a proportion of at least 0.59 for the reference/comparative bright stocks and less than 0.58, or less than 0.57, or less than 0.56, or less than 0.55 or less than 0.52 for the inventive bright stocks.

Another difference in the composition of the inventive bright stocks is the cycloparaffinic distribution as measured by FTICR-MS and/or FDMS, as shown in FIG. 13. These measurements indicate that the inventive bright stocks have a higher number of molecules with 2 rings: less than 18.01 per 100 molecules for the reference/comparative bright stocks and at least 17.0, or at least 18.01, or at least 18.5, or at least 19, or at least 20 (i.e., at least 20.0 molecules per 100 molecules of the composition), or at least 20.07 per 100 molecules for Samples A, B, and C. Molecules with 3 rings follow a similar trend with less than 19.7 per 100 molecules for the reference/comparative bright stocks and at least 19.7, or at least 20 (i.e., at least 20.0 molecules per 100 molecules of the composition), or at least 20.5 or at least 20.62 per 100 molecules for the inventive bright stocks. Molecules with 6, 7 or 8 rings follow the opposite trend with fewer of these molecules in the inventive bright stocks with at least 7.2 molecules with 6 rings per 100 molecules in the reference/comparative bright stocks, at least 4.8 molecules with 7 rings and at least 2.1 molecules with 8 rings. The inventive brighstocks have less than 7.1, or less than 7 (i.e., less than 7.0 molecules per 100 molecules of the composition), or less than 6.9 or less than 6.8 molecules with 6 rings per 100 molecules, less than 4.2, or less than 4 (i.e., less than 4.0 molecules per 100 molecules of the composition), or less than 3.8, or less than 3.6 or less than 3.3 molecules with 7 rings per 100 molecules; and less than 2 (i.e., less than 2.0 molecules per 100 molecules of the composition), or less than 1.9, or less than 1.8 or less than 1.5 molecules with 8 rings per 100 molecules. Additionally the inventive bright stocks have less than 1 (i.e., less than 1.0 molecules per 100 molecules of the composition), or less than 0.9, or less than 0.8, or less than 0.3 molecules with 9 rings per 100 molecules.

Molecules with fewer rings are favored in the inventive bright stocks when comparing the number of molecules with 5 or more, 6 or more, 7 or more and 11 or more rings. For example the reference/comparative bright stocks have at least 25.6, 14.9, 7.3 and 0.02 molecules with 5 or more, 6 or more, 7 or more and 11 or more rings per 100 molecules, respectively. The inventive bright stocks have less than 25.5, or less than 25, or less than 24.5, or less than 24, or less than 23 molecules with 5 or more rings per 100 molecules, less than 15, or less than 14.5, or less than 14, or less than 13, or less than 12 molecules with 6 or more rings per 100 molecules, less than 7.2, or less than 7, or less than 6.5, or less than 6, or less than 5 molecules with 7 or more rings per 100 molecules, and less than 0.02, or less than 0.01 or 0 molecules with 11 or more rings per 100 molecules. Additionally, when comparing the ratio of molecules with at least 5 rings to those with 2 rings, the reference/comparative bright stocks have a ratio of at least 1.5 whereas the inventive bright stocks have a ratio of less than 1.4, or less than 1.3, or less than 1.2. The inventive bright stocks also have smaller ratios of molecules with at least 6 rings and molecules with at least 7 rings to those with 2 rings: less than 0.9, or less than 0.8, or less than 0.7, or less than 0.6 for molecules with at least 6 rings compares to those with 2 and less than 0.4, or less than 0.3 for molecules with at least 7 rings to those with 2 rings.

The overall distribution of rings demonstrates that the inventive bright stocks favor molecules with fewer number of rings. The reference bright stocks have at least 0.05%, at least 0.08%, at least 2.22%, at least 6.14%, at least 16.6% and at least 32.2% molecules with at least 11, at least 10, at least 8, at least 7, at least 6 and at least 5 rings, respectively. The inventive bright stocks have less than 0.05, or less than 0.03 or 0 molecules per 100 with at least 11 rings, less than 0.08, or less than 0.07 or 0 molecules per 100 with at least 10 rings, less than 2.2, or less than 2.1, or less than 2, or less than 1.9 or less than 1.5, or less than 1 molecule(s) per 100 with at least 8 rings, less than 6.5, or less than 4.5, or less than 4, or less than 3, or less than 2 per 100 molecules with at least 7 rings, less than 16, or less than 15, or less than 14, or less than 13, or less than 12, or less than 1, or less than 10 per 100 molecules with at least 6 rings and less than 30, or less than 29, or less than 28, or less than 27 or less than 26, or less than 25 per 100 molecules with at least 5 rings. The reference/comparative brighstocks also have less than 70 per 100 molecules with 4 or fewer rings as compared to the inventive bright stocks which have at least 70, or at least 71, or at least 72 or at least 74 per 100 molecules with 4 or fewer rings. This lower number of large ring species seen in the composition is also reflected in the lower Conradson Carbon Residue (CCR) values for Samples A, B, and C in FIG. 12.

The distribution of number of rings in the inventive bright stocks favors a lower number of rings. For example, the ratio of 5 and 6 ring molecules compared to 2 and 3 ring molecules is greater than 0.7 for the reference/comparative bright stocks and less than 0.7, or less than 0.65 or less than 0.6 for the inventive bright stocks. The ratio of 2 and 3 ring molecules to molecules with 1 ring is also larger in the inventive bright stocks: less than 3.5 per 100 for the reference/comparative bright stocks and at least 3.5, or at least 4 per 100 for the inventive. Additionally, when comparing the ratio of molecules with at least 5 rings to those with 3 or few or to those with 4 or fewer, additional differences are observed. The reference/comparative bright stocks have a ratio of molecules with at least 5 rings to those with three or fewer of at least 0.57 and a ratio of molecules with at least 5 rings to those with 4 or fewer of less than 0.43. The inventive bright stocks have a ratio of molecules with at least 5 rings to those with 3 or fewer of less than 0.57, or less than 0.55 or less than 0.53 and a ratio of molecules with at least 5 rings to those with 4 or fewer of at least 0.43, or at least 0.4 or at least 0.38.

ADDITIONAL EMBODIMENTS

Embodiment 1

A lubricant base stock composition comprising a T10 distillation point of at least 900° F. (482° C.), a viscosity index of at least 80; a saturates content of at least 90 wt % (or at least 95 wt %); a sulfur content of less than 300 wppm; a kinematic viscosity at 100° C. of at least 14 cSt; a kinematic viscosity at 40° C. of at least 320 cSt (or at least 340 cSt, or at least 350 cSt); and a sum of terminal/pendant propyl groups and terminal/pendant ethyl groups of at least 1.7 (or at least 1.8, or at least 1.9) per 100 carbon atoms of the composition.

Embodiment 2

The lubricant base stock composition of Embodiment 1, wherein a total number of terminal/pendant propyl groups is greater than 0.85 (or greater than 0.86, or greater than 0.87, or greater than 0.88, or greater than 0.90, or greater than 1.0)

per 100 carbon atoms of the composition, or wherein a total number of terminal/pendant ethyl groups is greater than 0.85 (or greater than 0.88, or greater than 0.90, or greater than 0.93, or greater than 1.0) per 100 carbon atoms of the composition, or a combination thereof.

Embodiment 3

The lubricant base stock composition of any of the above embodiments, a) wherein the lubricant base stock composition has a pour point of −6° C. or less, or −10° C. or less, or −15° C. or less, or −20° C. or less; b) wherein the lubricant base stock composition has a cloud point of 0° C. or less, or −2° C. or less, or −5° C. or less, or −10° C. or less; c) wherein the lubricant base stock composition comprises a difference between a pour point and a cloud point of 25° C. or less, or 20° C. or less, or 15° C. or less; or d) a combination of a) and b), a) and c), b) and c), or a) and b) and c).

Embodiment 4

The lubricant base stock composition of any of the above embodiments, wherein the lubricant base stock composition has a ratio of terminal/pendant propyl groups to epsilon carbon atoms of at least 0.060 (or at least 0.063, or at least 0.065); or wherein the lubricant base stock composition has a ratio of terminal/pendant ethyl groups to epsilon carbon atoms of at least 0.060 (or at least 0.064, or at least 0.065); or a combination thereof.

Embodiment 5

The lubricant base stock composition of any of the above embodiments, wherein the lubricant base stock composition has a ratio of a sum of terminal/pendant propyl groups and terminal/pendant ethyl groups to epsilon carbon atoms of at least 0.10 (or at least 0.13).

Embodiment 6

The lubricant base stock composition of any of the above embodiments, where the lubricant base stock has a turbidity of at least 1.5 and a cloud point of 0° C. or less, or wherein the lubricant base stock has a turbidity of at least 2.0, or wherein the lubricant base stock has a turbidity of 4.0 or less (or 3.5 or less, or 3.0 or less), or a combination thereof.

Embodiment 7

The lubricant base stock composition of any of the above embodiments, wherein the lubricant base stock composition comprises a T50 distillation point of at least 1000° F. (538° C.) or at least 1050° F. (566° C.), or comprises a T90 distillation point of at least 1150° F. (621° C.) or at least 1200° F. (649° C.), or a combination thereof.

Embodiment 8

The lubricant base stock composition of any of the above embodiments, wherein the lubricant base stock composition comprises (as determined by FDMS) at least 17 molecules including 2 saturated rings per 100 molecules (or at least 20 molecules per 100 molecules) and at least 20 molecules including 3 saturated rings per 100 molecules (or at least 22 molecules per 100 molecules).

Embodiment 9

The lubricant base stock composition of any of the above embodiments, wherein the lubricant base stock composition comprises a Conradson Carbon Residue content of 0.1 wt % or less, or 0.02 wt % or less.

Embodiment 10

The lubricant base stock composition of any of the above embodiments, wherein the lubricant base stock composition comprises (as determined by FDMS or as determined by FTICR-MS) less than 7 molecules including 6 saturated rings per 100 molecules, or less than 16 molecules (or less than 14 molecules) including 6 or more saturated rings per 100 molecules, or a ratio of molecules including 6 or more saturated rings to molecules including 2 saturated rings of 0.8 or less, or a combination thereof.

Embodiment 11

The lubricant base stock composition of any of the above embodiments, wherein the viscosity index is at least 90 (or at least 95, or at least 100, or at least 105, or at least 110, or at least 120), or wherein the kinematic viscosity at 100° C. is at least 20 cSt, or at least 25 cSt, or at least 28 cSt, or at least 30 cSt, or at least 32 cSt, or wherein the kinematic viscosity at 40° C. is at least 340 cSt, or at least 350 cSt, or a combination thereof.

Embodiment 12

The lubricant base stock composition of any of the above embodiments, wherein the lubricant base stock composition comprises less than 14.5 epsilon carbon atoms per 100 carbon atoms in the composition.

Embodiment 13

The lubricant base stock composition of any of the above embodiments, wherein the lubricant base stock composition comprises (as determined by FTICR-MS) less than 7 molecules including 6 saturated rings per 100 molecules, less than 4 molecules including 7 saturated rings per 100 molecules, less than 2 molecules including 8 saturated rings per 100 molecules, and less than 1 molecule including 9 saturated rings per 100 molecules.

Embodiment 14

The lubricant base stock composition of any of the above embodiments, wherein i) the lubricant base stock composition comprises (as determined by FDMS) at least 20 molecules including 2 saturated rings per 100 molecules and at least 22 molecules including 3 saturated rings per 100 molecules, the lubricant base stock composition optionally comprising a Conradson Carbon Residue content of 0.02 wt % or less; ii) the lubricant base stock composition comprises (as determined by FDMS) less than 7 molecules including 6 saturated rings per 100 molecules, the lubricant base stock composition optionally comprising a Conradson Carbon Residue content of 0.1 wt % or less; or iii) a combination of i) and ii).

Embodiment 15

The lubricant base stock composition of any of the above embodiments, wherein the lubricant base stock composition comprises (as determined by FTICR-MS) less than 16 molecules including 6 or more saturated rings per 100 molecules, or a ratio of molecules including 1 to 3 saturated rings relative to molecules including 4 to 6 saturated rings of at least 1.1, or a combination thereof.

Embodiment 16

A formulated lubricant comprising the lubricant base stock composition of any of Embodiments 1-15 or 18-19 and at least one additive.

Embodiment 17

The formulated lubricant of Embodiment 16, wherein the at least one additive comprises one or more detergents, dispersants, antioxidants, viscosity modifiers, and/or pour point depressants; or wherein the at least one additive comprises one or more defoamants, pour point depressants, antioxidants, and/or rust inhibitors; or wherein the formulated lubricant further comprises one or more additional base stocks, the one or more additional base stocks comprising solvent processed base stocks, hydroprocessed base stocks, synthetic base stocks, base stocks derived from Fisher-Tropsch processes, PAO, and naphthenic base stocks; or a combination thereof.

Embodiment 18

The lubricant base stock composition of any of Embodiments 1-15, wherein the lubricant base stock composition has a combined number of alpha carbons, terminal/pendant propyl groups, and terminal/pendant ethyl groups of at least 3.9 per 100 carbon atoms of the composition, or at least 4.1 per 100.

Embodiment 19

The lubricant base stock composition of any of Embodiments 1-15 or 18, wherein the lubricant base stock composition has a number of alpha carbons of less than 2.8 per 100 carbon atoms of the composition, or at least 2.1 per 100 carbon atoms of the composition, or a combination thereof.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A lubricant base stock composition comprising:

a T10 distillation point of at least 900° F. (482° C.);

a viscosity index of at least 80;

a saturates content of at least 90 wt %;

a sulfur content of less than 300 wppm;

a kinematic viscosity at 100° C. of at least 14 cSt;

a kinematic viscosity at 40° C. of at least 320 cSt;

a cloud point of −2° C. or less; and a sum of terminal/pendant propyl groups and terminal/pendant ethyl groups of at least 1.7 per 100 carbon atoms of the composition.

2. The lubricant base stock composition of claim 1, wherein a total number of terminal/pendant propyl groups is greater than 0.86 per 100 carbon atoms of the composition, or wherein a total number of terminal/pendant ethyl groups is greater than 0.88 per 100 carbon atoms of the composition, or a combination thereof.

3. The lubricant base stock composition of claim 1, wherein the lubricant base stock composition has a pour point of −6° C. or less.

4. The lubricant base stock composition of claim 1, wherein the lubricant base stock composition comprises a difference between a pour point and a cloud point of 25° C. or less.

5. The lubricant base stock composition of claim 1, wherein the lubricant base stock composition has a ratio of terminal/pendant propyl groups to epsilon carbon atoms of at least 0.060; or wherein the lubricant base stock composition has a ratio of terminal/pendant ethyl groups to epsilon carbon atoms of at least 0.060; or a combination thereof.

6. The lubricant base stock composition of claim 1, wherein the lubricant base stock composition has a ratio of a sum of terminal/pendant propyl groups and terminal/pendant ethyl groups to epsilon carbon atoms of at least 0.10.

7. The lubricant base stock composition of claim 1, wherein the lubricant base stock composition has a turbidity of at least 1.5 and a cloud point of 0° C. or less, or wherein the lubricant base stock composition has a turbidity of at least 2.0, or wherein the lubricant base stock has a turbidity of 4.0 or less composition, or a combination thereof.

8. The lubricant base stock composition of claim 1, wherein the lubricant base stock composition comprises a T5O distillation point of at least 1000° F. (538° C.), or comprises a T90 distillation point of at least 1150° F. (621° C.), or a combination thereof.

9. The lubricant base stock composition of claim 1, wherein the lubricant base stock composition comprises (as determined by FDMS) at least 17 molecules including 2 saturated rings per 100 molecules and at least 20 molecules including 3 saturated rings per 100 molecules.

10. The lubricant base stock composition of claim 1, wherein the lubricant base stock composition comprises a Conradson Carbon Residue content of 0.1 wt % or less.

11. The lubricant base stock composition of claim 1, wherein the lubricant base stock composition comprises (as determined by FDMS) less than 7 molecules including 6 saturated rings per 100 molecules, or less than 16 molecules including 6 or more saturated rings per 100 molecules, or a combination thereof.

12. The lubricant base stock composition of claim 1, wherein the viscosity index is at least 100, or wherein the kinematic viscosity at 100° C. is at least 20 cSt, or a combination thereof.

13. The lubricant base stock composition of claim 1, wherein a total number of terminal/pendant propyl groups is greater than 0.86 per 100 carbon atoms of the composition, or wherein a total number of terminal/pendant ethyl groups is greater than 0.88 per 100 carbon atoms of the composition, or a combination thereof, and wherein the lubricant base stock composition has a kinematic viscosity at 100° C. of at least 20 cSt.

14. The lubricant base stock composition of claim 13, wherein the lubricant base stock composition has a ratio of terminal/pendant propyl groups to epsilon carbon atoms of at least 0.063; or wherein the lubricant base stock composition has a ratio of terminal/pendant ethyl groups to epsilon carbon atoms of at least 0.064; or wherein the lubricant base stock composition has a ratio of a sum of terminal/pendant propyl groups and terminal/pendant ethyl groups to epsilon carbon atoms of at least 0.13; or a combination thereof.

15. The lubricant base stock composition of claim 1, wherein the lubricant base stock composition comprises (as determined by FDMS) at least 20 molecules including 2 saturated rings per 100 molecules and at least 22 molecules including 3 saturated rings per 100 molecules, the lubricant base stock composition optionally comprising a Conradson Carbon Residue content of 0.02 wt % or less.

16. The lubricant base stock composition of claim 15, wherein the lubricant base stock comprises a saturates content of at least 95 wt %.

17. The lubricant base stock composition of claim 1, wherein the lubricant base stock composition comprises (as determined by FDMS) less than 7 molecules including 6 saturated rings per 100 molecules, the lubricant base stock composition optionally comprising a Conradson Carbon Residue content of 0.1 wt % or less.

18. The lubricant base stock composition of claim 1, wherein the lubricant base stock composition comprises (as determined by FDMS) less than 16 molecules including 6 or more saturated rings per 100 molecules, or a ratio of molecules including 1 to 3 saturated rings relative to molecules including 4 to 6 saturated rings of at least 1.1, or a combination thereof.

19. The lubricant base stock composition of claim 1, further comprising at least one additive to form a formulated lubricant.

20. The formulated lubricant of claim 19, wherein the at least one additive comprises one or more detergents, dispersants, antioxidants, viscosity modifiers, and/or pour point depressants, defoamants, and/or rust inhibitors.

21. The formulated lubricant of claim 19, wherein the formulated lubricant further comprises one or more additional base stocks, the one or more additional base stocks comprising solvent processed base stocks, hydroprocessed base stocks, synthetic base stocks, base stocks derived from Fisher-Tropsch processes, PAO, and naphthenic base stocks.

22. A lubricant base stock composition comprising:

a T10 distillation point of at least 900° F. (482° C.);

a viscosity index of at least 80;

a saturates content of at least 90 wt %;

a sulfur content of less than 300 wppm;

a kinematic viscosity at 100° C. of at least 14 cSt;

a kinematic viscosity at 40° C. of at least 350 cSt;

a cloud point of −2° C. or less; and a sum of terminal/pendant propyl groups and terminal/pendant ethyl groups of at least 1.7 per 100 carbon atoms of the composition.

23. The lubricant base stock composition of claim 22, wherein a total number of terminal/pendant propyl groups is greater than 0.85 per 100 carbon atoms of the composition, or wherein a total number of terminal/pendant ethyl groups is greater than 0.85 (or greater than 0.90) per 100 carbon atoms of the composition, or a combination thereof.

24. The lubricant base stock composition of claim 22, wherein the lubricant base stock composition has a pour point of −10° C. or less or a difference between a pour point and a cloud point of 25° C. or less, or a combination thereof.

25. The lubricant base stock composition of claim 22, wherein the lubricant base stock composition comprises less than 14.5 epsilon carbon atoms per 100 carbon atoms in the composition.

26. The lubricant base stock composition of claim 22, wherein the lubricant base stock composition has a ratio of terminal/pendant propyl groups to epsilon carbon atoms of at least 0.060; or wherein the lubricant base stock composition has a ratio of terminal/pendant ethyl groups to epsilon carbon atoms of at least 0.060; or a combination thereof.

27. The lubricant base stock composition of claim 22, wherein the lubricant base stock composition has a ratio of a sum of terminal/pendant propyl groups and terminal/pendant ethyl groups to epsilon carbon atoms of at least 0.10.

28. The lubricant base stock composition of claim 22, wherein the lubricant base stock composition comprises (as determined by FDMS) at least 17 molecules including 2 saturated rings per 100 molecules (or at least 20 molecules per 100 molecules) and at least 20 molecules including 3 saturated rings per 100 molecules (or at least 22 molecules per 100 molecules).

29. The lubricant base stock composition of claim 22, wherein the lubricant base stock composition comprises (as determined by FTICR-MS) less than 7 molecules including 6 saturated rings per 100 molecules, less than 4 molecules including 7 saturated rings per 100 molecules, less than 2 molecules including 8 saturated rings per 100 molecules, and less than 1 molecule including 9 saturated rings per 100 molecules.

30. The lubricant base stock composition of claim 22, wherein the lubricant base stock composition comprises (as determined by FTICR-MS) less than 15 molecules including 6 or more saturated rings per 100 molecules, or a ratio of molecules including 6 or more saturated rings to molecules including 2 saturated rings of 0.8 or less, or a combination thereof.

31. The lubricant base stock composition of claim 22, wherein the lubricant base stock composition comprises (as determined by FTICR-MS) less than 1 molecules including 9 or more saturated rings per 100 molecules, at least 19 molecules including 2 saturated rings per 100 molecules, and at least 20 molecules including 3 saturated rings per 100 molecules.

* * * * *